US011098563B1

(12) United States Patent
Ludwig

(10) Patent No.: US 11,098,563 B1
(45) Date of Patent: Aug. 24, 2021

(54) PERFORATING GUN CONNECTION SYSTEM

(71) Applicant: Halliburton Energy Services, Inc., Houston, TX (US)

(72) Inventor: Wesley Neil Ludwig, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/911,527

(22) Filed: Jun. 25, 2020

(51) Int. Cl.

| | |
|---|---|
| ***E21B 43/119*** | (2006.01) |
| ***E21B 43/116*** | (2006.01) |
| ***F42D 5/00*** | (2006.01) |
| ***E21B 43/117*** | (2006.01) |
| *E21B 43/1185* | (2006.01) |

(52) U.S. Cl.
CPC ..... *E21B 43/119* (2013.01); *E21B 43/116* (2013.01); *E21B 43/117* (2013.01); *F42D 5/00* (2013.01); *E21B 43/1185* (2013.01)

(58) Field of Classification Search
CPC .... E21B 43/116; E21B 43/117; E21B 43/119; E21B 43/1185; F42D 5/00
See application file for complete search history.

(56) References Cited

U.S. PATENT DOCUMENTS 4,598,776 A * 7/1986 Stout ..... E21B 43/117 175/4.54
4,776,393 A 10/1988 Forehand et al.
4,850,438 A * 7/1989 Regalbuto ..... E21B 43/117 175/4.56
5,052,489 A * 10/1991 Carisella ..... E21B 43/1185 166/297
5,131,470 A 7/1992 Miszewski et al.
8,978,749 B2 3/2015 Rodgers et al.
9,080,433 B2 * 7/2015 Lanclos ..... F42D 1/05
(Continued)

FOREIGN PATENT DOCUMENTS

WO 2006102171 A2 9/2006
WO 2013032456 A1 3/2013

OTHER PUBLICATIONS

Foreign Communication from Related Application—International Search Report and Written Opinion of the International Searching Authority, International Application No. PCT/US2020/040152, dated Mar. 15, 2021, 10 pages.

*Primary Examiner* — Yong-Suk (Philip) Ro
(74) *Attorney, Agent, or Firm* — Conley Rose, P.C.; Rodney B. Carroll

(57) ABSTRACT

A perforating gun apparatus comprising a bulkhead connector located between an upper gun body thread and lower gun body thread. The bulkhead connector has seals in sealing arrangement with an upper gun body and a lower gun body with a support sleeve in contact with an inner groove support shoulder on the lower gun body. The support sleeve is radially deformable into the inner groove by a shockwave produced by firing the charges in the lower gun section. The deformation of the support sleeve attenuates the impact of the shockwave on the threaded connection. The bulkhead connector isolates the threaded connection from the pressure spike. The deformed support sleeve attenuates the shockwave from the charges firing in the upper gun section and transfers the resultant force away from the threaded connection.

20 Claims, 19 Drawing Sheets

(56) References Cited

U.S. PATENT DOCUMENTS

| | | | | |
|---|---|---|---|---|
| 9,145,764 | B2 * | 9/2015 | Burton | H02G 9/00 |
| 9,598,940 | B2 | 3/2017 | Rodgers et al. | |
| 2010/0000789 | A1 * | 1/2010 | Barton | E21B 43/11852 175/2 |
| 2012/0247769 | A1 * | 10/2012 | Schacherer | E21B 43/117 166/297 |
| 2013/0048376 | A1 * | 2/2013 | Rodgers | E21B 43/1195 175/4.6 |
| 2013/0213668 | A1 | 8/2013 | Hales et al. | |
| 2016/0084048 | A1 | 3/2016 | Harrigan et al. | |
| 2017/0211363 | A1 * | 7/2017 | Bradley | E21B 17/042 |
| 2018/0299239 | A1 | 10/2018 | Eitschberger et al. | |
| 2019/0234188 | A1 | 8/2019 | Goyeneche | |

* cited by examiner

PERFORATING GUN CONNECTION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present technology pertains to perforating a cased wellbore that traverses a subterranean formation, and more specifically pertains to a connection assembly for a perforating gun apparatus.

BACKGROUND

Wellbores are drilled into the earth for a variety of purposes including tapping into hydrocarbon bearing formations to extract the hydrocarbons for use as fuel, lubricants, chemical production, and other purposes. When a wellbore has been completed, a metal tubular casing may be placed and cemented in the wellbore. Thereafter, a perforation tool assembly may be run into the casing, and one or more perforation guns in the perforation tool assembly may be activated and/or fired to perforate the casing and/or the formation to promote production of hydrocarbons from selected formations. Perforation guns may comprise one or more explosive charges that may be selectively activated, the detonation of the explosive charges desirably piercing the casing and penetrating at least partly into the formation proximate to the wellbore.

Perforating gun assemblies may include multiple gun sections that are assembled at the wellsite before being run into the casing. The number of gun sections assembled depends on the desired length of perforations for a zone and the number of zones. A perforating gun apparatus may perforate a single zone or multiple zones. When the perforating gun apparatus returns to surface, the used gun sections are disassembled for removal from the wellsite.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
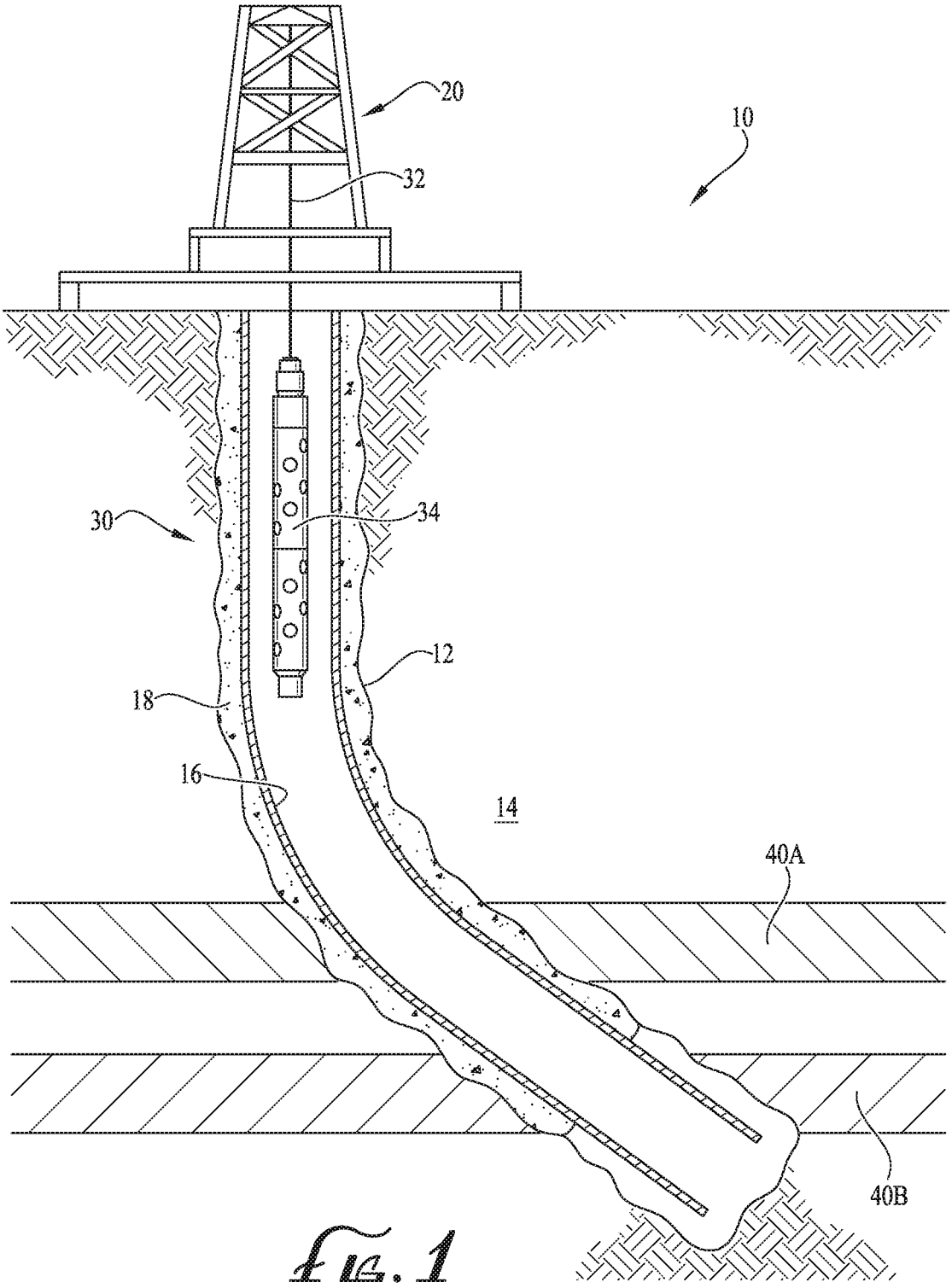
FIG. 1 is a schematic diagram of a wellbore and workstring according to an embodiment of the disclosure.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Upon activation of a perforating gun, the instantaneous pressure created by the shape charges firing creates an internal shockwave, a shockwave inside the gun section, that impacts the top and bottom threaded connection of each gun body. The threaded connections may become damaged or overstressed by the impact of the internal shockwave. The damaged threaded connections may prevent the gun body from being unthreaded when the gun assembly returns to the surface. The damaged threads prevent the gun bodies from being disassembled resulting in service personnel having to remove 30 foot, 60 foot, or 90 foot long assemblies of gun bodies stuck together from the wellbore. The elevators on the derrick of a workover rig may not be able to lift gun sections longer than 90 foot due to the limits of block travel. The long spent stuck together gun sections are hazardous to handle and may force service personnel at the surface to cut apart the gun sections or to cut apart the damaged threads. The removal of long gun sections from the well, the handling of spent gun sections, and the cutting apart of gun sections presents a safety hazard to the service personnel at surface.

The present disclosure describes a perforating gun apparatus for use in a wellbore comprising a threaded connection capable of attenuating the internal shockwave and instantaneous pressure spike associated with firing a gun section that perforates the casing. Whereby attenuating the shockwave may reduce the risk of damaging the threaded connection.

FIG. 1 illustrates a schematic view of an embodiment of a wellbore operating environment in which a perforating gun apparatus may be deployed. As depicted, the wellbore operating environment 10 comprises a servicing rig 20 that extends over and around a wellbore 12 that penetrates a subterranean formation 14 for the purpose of recovering hydrocarbons from a first production zone 40A and a second production zone 40B, collectively the production zones "40". The wellbore 12 may be drilled into the subterranean formation 14 using any suitable drilling technique. While shown as extending vertically from the surface in FIG. 1, the wellbore 12 may also be deviated, horizontal, and/or curved over at least some portions of the wellbore 12. For example, the wellbore 12, or a lateral wellbore drilled off of the wellbore 12, may deviate and remain within one of the production zones 40. The wellbore 12 may be cased, open hole, contain tubing, and may generally be made up of a hole in the ground having a variety of shapes and/or geometries as is known to those of skill in the art. In the illustrated embodiment, a casing 16 may be placed in the wellbore 12 and secured at least in part by cement 18.

The servicing rig 20 may be one of a drilling rig, a completion rig, a workover rig, or other mast structure and supports a workstring 30 in the wellbore 12, but a different structure may also support the workstring 30. The servicing rig 20 may also comprise a derrick with a rig floor through which the workstring 30 extends downward from the servicing rig 20 into the wellbore 12. In some cases, such as in an off-shore location, the servicing rig 20 may be supported by piers extending downwards to a seabed. Alternatively, the servicing rig 20 may be supported by columns sitting on hulls and/or pontoons that are ballasted below the water surface, which may be referred to as a semi-submersible platform or rig. In an off-shore location, a casing 16 may extend from the servicing rig 20 to exclude sea water and contain drilling fluid returns. It is understood that other mechanical mechanisms, not shown, may control the run-in and withdrawal of the workstring 30 in the wellbore 12, for example a draw works coupled to a hoisting apparatus, another servicing vehicle, a coiled tubing unit and/or other apparatus.

As illustrated, the workstring 30 may include a conveyance 32 and a perforating gun apparatus 34. The conveyance 32 may be any of a string of jointed pipes, a slickline, a coiled tubing, and a wireline. In other examples, the workstring 30 may further contain one or more downhole tools (not shown in FIG. 1), for example above the perforating gun apparatus 34. The workstring 30 may have one or more packers, one or more completion components such as screens and/or production valves, sensing and/or measuring equipment, and other equipment which are not shown in FIG. 1. In some contexts, the workstring 30 may be referred to as a tool string. The workstring 30 may be lowered into the wellbore 12 to position the perforating gun apparatus 34 to perforate the casing 16 and penetrate one or more of the production zones 40.

Many components of the wellbore operating environment 10 can be assembled in the field, including the portions of the perforating gun. The perforating gun apparatus 34 may be tubing conveyed or wireline conveyed. In preparing a perforating gun, individual charge tubes are inserted into gun bodies of the perforating gun apparatus by, for example, a gun loader. Each charge tube is assembled, for example by adding the charges, and then the charge tube is inserted into the gun body and aligned with the scallops of the gun body. In some cases, a perforating gun may be loaded or assembled immediately before conveying the gun into the wellbore.

Figure 2:
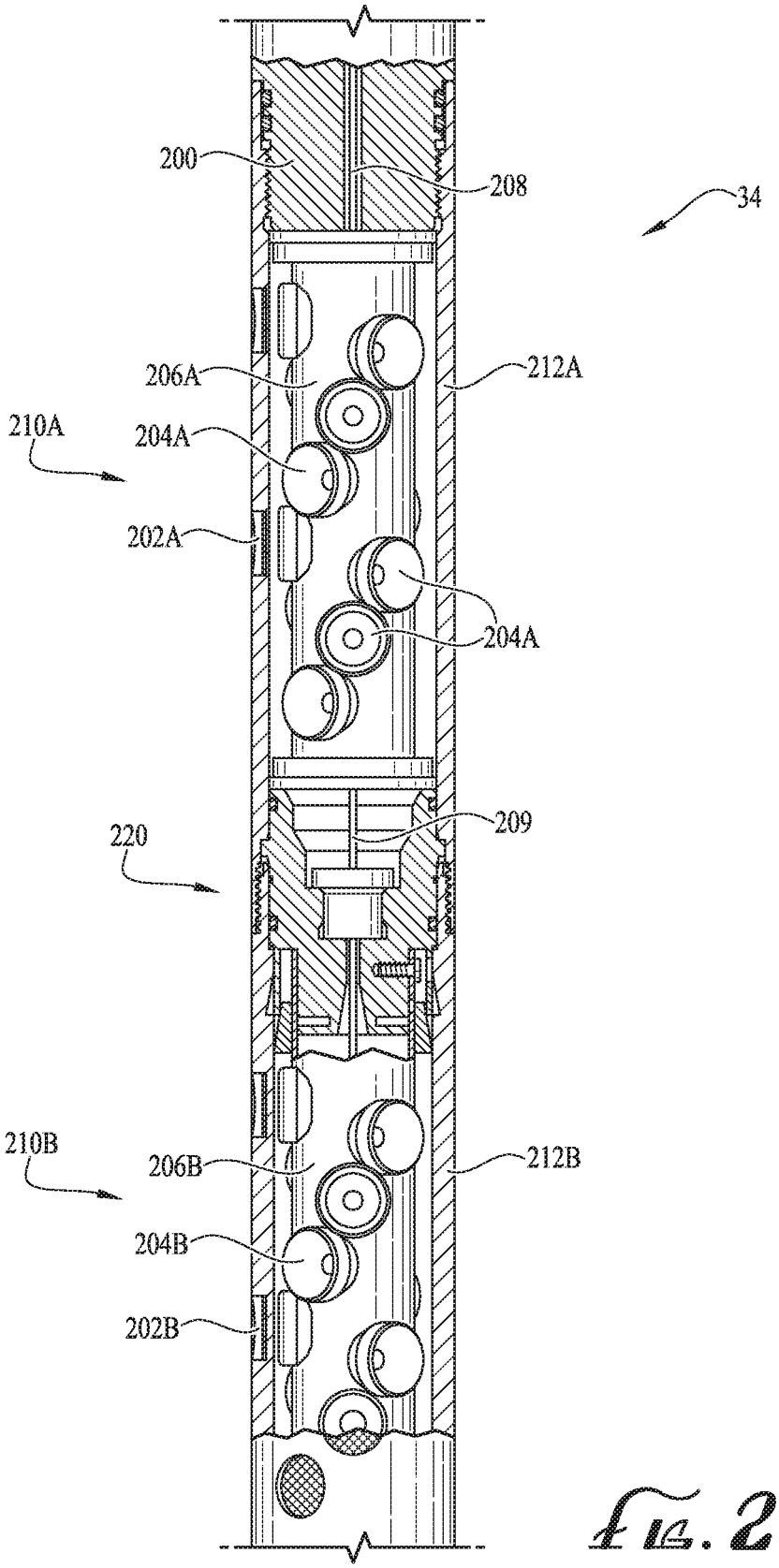
FIG. 2 is cut-away view of an embodiment of a perforating gun apparatus.

FIG. 2 illustrates a cut-away view of an embodiment of the perforating gun apparatus 34 that may be lowered into the wellbore 12 during a perforation operation. The perforating gun apparatus 34 may be of conventional design which may comprise a plurality of explosive devices 204 (e.g., perforating charges or shaped charges) disposed within a gun body 212 that are detonated in order to perforate the casing (e.g., casing 16 of FIG. 1). The perforating gun apparatus 34 may also include elements such as a charge carrier 206, a detonation cord 208, boosters, communication cable 209, and/or other types of detonation transfer components. The detonation cord 208 may couple to each perforating charge 204. The perforating gun apparatus 34 may be coupled to the workstring via the upper end portion 200. The perforating gun apparatus 34 may be coupled to additional perforating guns via the bulkhead connector 220. The upper end portion 200 and the bulkhead connector 220 can include various connecting pieces, such as tandems, communication cable 209, connectors, various male or female threaded units, or other connecting units, along with any associated seals.

The gun body may have locations to allow the perforating charge material to more easily blast through the gun body after detonation of charges. Scallops 202 optimize charge performance and prevent casing damage from perforating exit hole burrs. A perforating gun apparatus 34 may include an upper gun section 210A and a lower gun section 210B. Each gun section may include at least one perforating charge 204 disposed within the gun body 212. The gun body 212 may have a plurality of recesses or "scallops" 202 on an exterior surface of the gun body 212. The scallops 202 provide a path for the perforating charge material to more easily blast through after detonation of charges. A perforating charge 204 generally has a conical metal outer lining that contains an explosive powder, energetic powder, or similar material that is activated or ignited to pierce through the scallops 202 of the gun body 212, the casing or wellbore, and penetrate the formation. The gun body 212 can be formed of any material, such as plastics, metals, ceramics, or combinations of materials, e.g. a metal and a plastic, may be employed.

The perforating charges 204 may be arranged in various configurations, for example, a helical configuration. Another configuration or pattern of perforating charges 204 may also be used. The perforating charge 204 may be any type of perforation charge that is known in the art. The perforating charge 204 may be a shaped charge that is designed to focus a resulting explosive jet in a predetermined direction. The focused jet may include a cohesive jet and/or a projectile or a slug of liquefied metal. Each perforating charge 204 may have a metal liner surrounded on the convex side by an explosive material, and a charge case may surround the explosive material and liner.

While the perforating gun apparatus 34 is shown in FIG. 2 as two perforating gun sections (210A & 210B), it is to be understood that the perforating gun apparatus 34 may consist of one, two, or more perforating gun sections 210 coupled together with any number of perforating charges per perforating gun section 210 as long as the finally constructed perforating gun apparatus 34 can be fitted into a wellbore and conveyed by the conveyance 32.

In some examples, the perforating gun apparatus 34 may include any number of additional components (e.g., end caps, blank sections, spacers, transfer subs, etc.), which may be assembled in a string.

Detonation of the perforating charges 204 pierces the casing and allows fluids to enter the wellbore from the production zone. The near simultaneous detonation of the perforating charges 204 and the detonation cord 208 may create an internal shockwave, an instantaneous pressure spike that travels at the speed of sound, inside the gun body that impacts the top and bottom threaded connection of each gun body 212. The terminal ends of the gun body 212 can become damaged or overstressed by the impact of the internal shockwave.

After the detonation of the perforating charges 204, fluids from the wellbore may rush into the perforating gun apparatus 34 with great velocity as the perforating gun apparatus 34 acts as a pressure sink. Additionally, the high density of completion fluids produces very high fluid inertia. The column of compressible air remaining in the perforating gun apparatus 34 following detonation gives the completion fluid additional distance to accelerate before encountering the hard stop at the terminal ends of the perforating gun apparatus 34. The resultant pressure spike can damage the perforating gun apparatus 34 and other downhole tools during perforation operations. In the case of the perforating gun apparatus 34 shown in FIG. 2, the pressure spike may be greatest at the upper end portions 200 or bulkhead connector 220 where the inrushing fluids encounter the hard stop at the terminal ends of the perforating gun sections 210.

The force generated by the firing of a perforating gun section 210 may be the shockwave created by the near simultaneous detonation of the perforating charges 204 and the detonation cord 208, an instantaneous pressure spike created by the detonation, the inrush of high density completion fluids impacting the terminal ends of the perforating gun sections 210, or any combination of events.

In normal operation, the gun apparatus 34 may be assembled from gun sections 210 by service personnel at the servicing rig 20. Each gun section 210 may include a gun body 212 with an upper thread and lower thread and a bulkhead connector 220 attached to one end. The service personnel may arm each gun section with a detonator or other equipment before assembling the gun sections together. The gun apparatus 34 may be lowered on workstring 32 into the wellbore 12 and to a zone 40 in the subterranean formation 14. One of the perforating gun sections 210 may be fired from a command given at surface by service personnel to perforate the casing 16 so that production fluid may enter the wellbore 12 from the zone 40. The perforating gun apparatus 34 may selectively fire one gun section 210 to perforate a first zone 40 and then be repositioned in the wellbore 12 to perforate a second zone. For example, the gun apparatus 34 may be lowered into the wellbore 12 by the workstring 32 to zone 40B. The lower gun section 210B may be selectively fired from surface by command from service personnel to perforate casing 16 in zone 40B. The gun apparatus 34 may be raised from zone 40B to zone 40A. The upper gun section 210A may be selectively fired from surface by command from service personnel to perforate casing 16 in zone 40A. The gun apparatus 34 may then be returned to surface by workstring 32 and disassembled by service personnel at the servicing rig 20.

Figure 3:
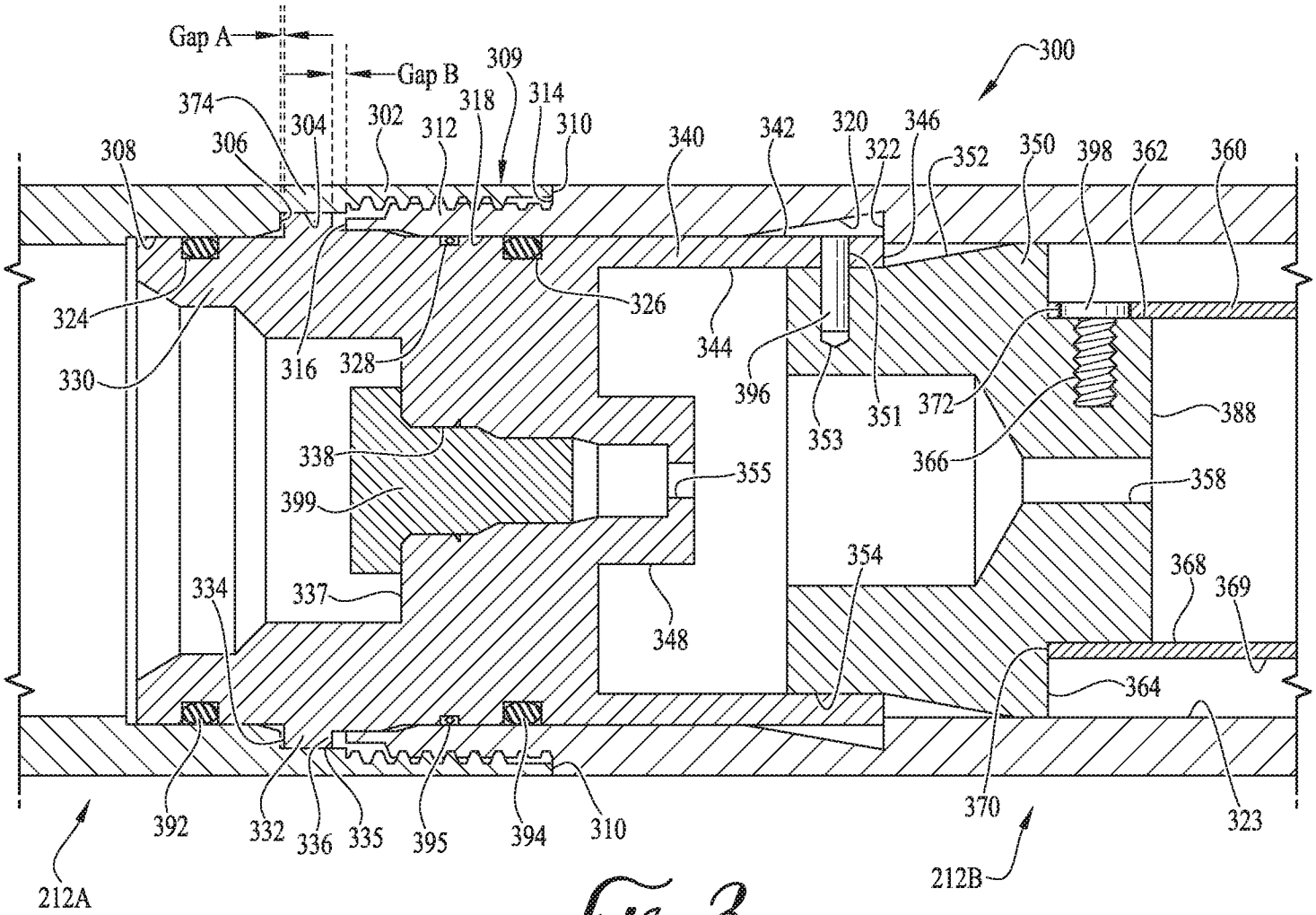
FIG. 3 is a cross-sectional view of an embodiment of a perforating gun apparatus comprising a shockwave attenuating connection.

FIG. 3 illustrates a cross-sectional view of an embodiment of the threaded bulkhead connection 300 configured to attenuate the internal shockwave created by the perforating gun sections. The upper gun body 212A may be threadingly attached to the upper end portion 200 and may be uphole of the threaded bulkhead connection 300. The threaded bulkhead connection 300 may comprise a bulkhead connector 330, bulkhead wedge 350, upper gun body thread 302, lower gun body thread 312, and charge carrier 360. The upper gun body 212A may be threadingly connected to lower gun body 212B with threaded connection 309. The threaded connection 309 of upper gun body thread 302 may be threadingly mated to lower gun body thread 312 until upper thread surface 310 engages lower thread surface 314. The upper gun body thread 302 forms a gun body housing 374 that includes upper shoulder surface 306, inner surface 304, and upper sealing surface 308. The lower gun body thread 312 may include lower shoulder surface 316, lower seal surface 318, inner groove 320, and lower seating shoulder 322.

Bulkhead connector 330 may be attached to and support bulkhead wedge 350 and charge carrier 360. Bulkhead connector 330 may be connected to bulkhead wedge 350 by connector pin 396. Charge carrier 360 may be connected to bulkhead wedge 350 by screw 398.

Bulkhead connector 330 may be cylindrical with an outer surface 335 and a support ring 332 having an upper support shoulder 334 and lower support shoulder 336. Bulkhead connector 330 may be installed inside gun body housing 374 with an allowance fit between outer surface 335 and inner surface 304 of upper gun body thread 302. The support ring 332 of the bulkhead connector 330 may be free to move axially inside gun body housing 374 between upper shoulder surface 306 and shoulder surface 316. The upper support shoulder 334 of the bulkhead connector 330 and upper shoulder surface 306 may be separated by Gap A. The lower support shoulder 336 of the bulkhead connector 330 and shoulder surface 316 may be separated by Gap B. The bulkhead connector 330 may have upper seal groove 324 with upper seal 392 in sealing engagement with upper sealing surface 308 of the upper gun body 212A. The bulkhead connector 330 may have lower seal groove 326 with lower seal 394 in sealing engagement with lower seal surface 318 of lower gun body 212B. The bulkhead connector 330 may allow wellbore fluid to enter the threaded connection 309 of upper gun body thread 302 and lower gun body thread 312 while isolating the upper gun section 210A and lower gun section 210B from wellbore fluids with upper seal 392 in sealing engagement with upper sealing surface 308 and lower seal 394 in sealing engagement with lower seal surface 318. The bulkhead connector 330 may have grounding spring groove 328 with grounding spring 395 forming an electrically conductive path between lower seal surface 318 of lower gun body 212B and grounding spring groove 328 of bulkhead connector 330. The bulkhead connector may have an equipment receptacle 337 with an inner threaded receptacle 338 and seal surface for detonators, isolators, and other equipment. For example, the plug 399 may represent isolators, detonators, and other equipment that sealingly attach to the equipment receptacle to isolate the upper gun body 212A from the lower gun body 212B and provide a communication path for the communication cable 209. In an alternate embodiment, the plug 399 may not seal, but pass a detonator cord 208 from the upper gun body 212A to the lower gun body 212B.

The bulkhead connector may have support sleeve 340 with outer sleeve surface 342, inner sleeve surface 344, and support sleeve end surface 346. Outer sleeve surface 342 may be slidingly engaged with an allowance fit between outer sleeve surface 342 and lower seal surface 318. The bulkhead connector 330 may have inner connector protrusion 348 for engagement with associated equipment and lower port 355 for passage of a detonator cord 208 or communication cable 209. The bulkhead connector 330 may have support sleeve end surface 346 engaged with lower seating shoulder 322 to support bulkhead connector 330 between upper gun body 212A and lower gun body 212B. Bulkhead connector 330 may be held in place between contacting lower seating shoulder 322 and support sleeve end surface 346 and Gap A between upper support shoulder 334 and upper shoulder surface 306. In an alternate embodiment, support sleeve 340 may be a separate part and threadingly attached, connected with fasteners, or slidingly connected to bulkhead connector 330.

The bulkhead wedge 350 may be held in place by connector pin 396 installed in support sleeve hole 351 and wedge hole 353. Connector pin 396 may be made from a material designed to shear when subjected to a specified load. The connector pin 396 may comprise brass, stainless steel, annealed steel, nickel steel, or any other shearable material known to those in the arts. The bulkhead wedge 350 may be a cylinder with an outer surface 354 in sliding engagement with inner sleeve surface 344 and a wedge surface 352 that may be frustoconical in shape. The bulkhead wedge 350 may have an inner surface 356 and a cable port 358. The lower end of the bulkhead wedge 350 may have a lower outer surface 362, an end shoulder surface 364, and a lower pin hole 366.

The charge carrier 360 may be a cylinder with an outer surface 369, an inner surface 368, and an upper end surface 370. The upper end of the charge carrier may have one or more support holes 372 to receive the screw head of screw 398. The pin hole 366 may be threaded to receive screw 398.

The charge carrier 360 may be connected to the bulkhead wedge 350 by screw 398.

The inner surface 368 of charge carrier 360 slidingly fits onto the outer surface 362 of bulkhead wedge 350. The upper end surface 370 may abut end shoulder surface 364. The screw 398 may fit into support hole 372. Although one screw 398 is shown, multiple screws 398 and support holes 372 may be located around the outer surface 369 of the charge carrier 360.

Figure 4:
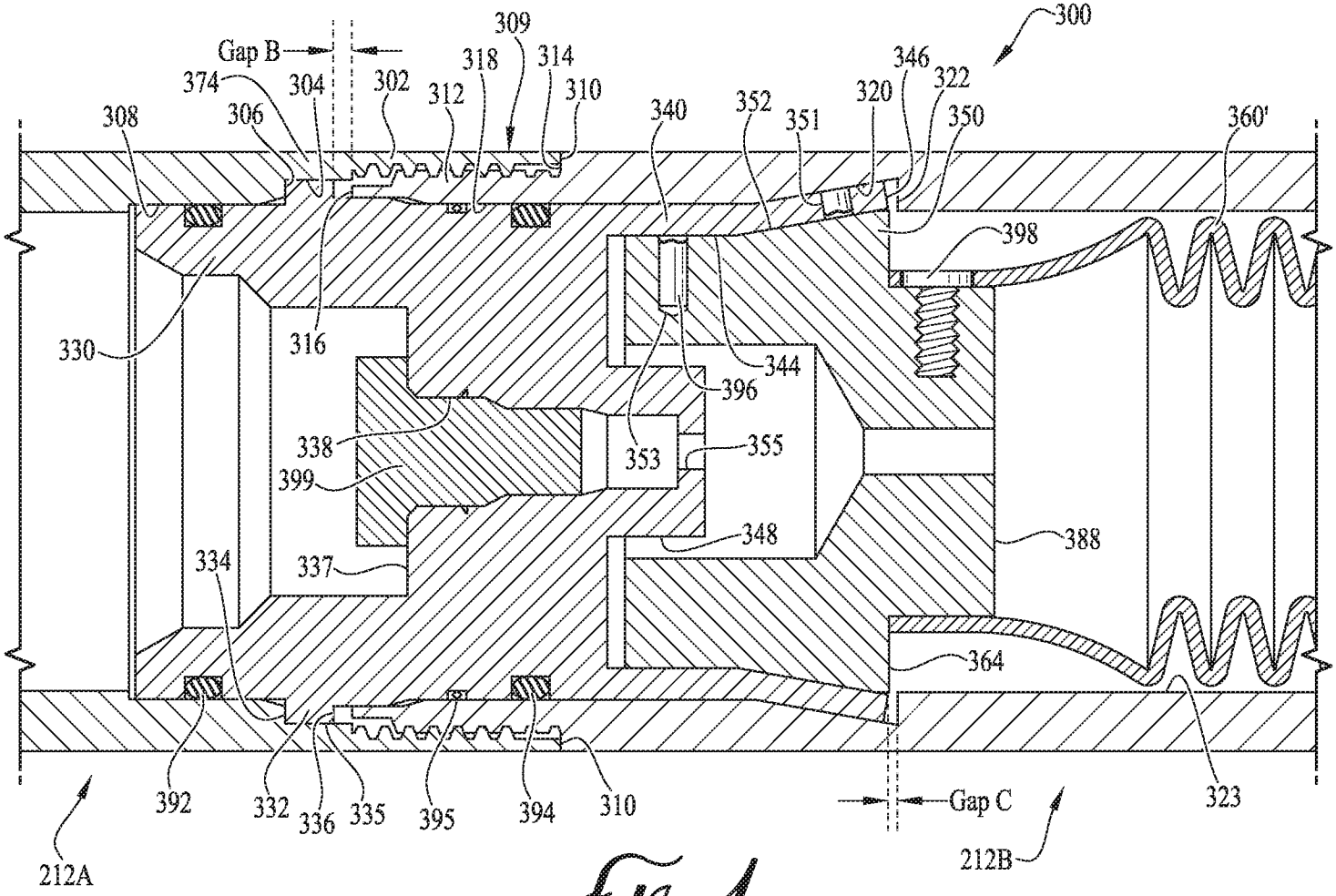
FIG. 4 is a cross-sectional view of an embodiment of a perforating gun apparatus after the lower gun section fires.

Turning now to FIG. 4, the perforating charges 204 in a first gun section may be fired from a command given at surface by service personnel resulting in the threaded bulkhead connection 300 being reconfigured as shown. The force generated by the firing of the first gun section 210, in this embodiment a lower gun section 210B, may be a shockwave from the near simultaneous firing of the charges and the detonator cord 208, an instantaneous pressure spike, from the inrush of wellbore fluids, or a combination of those events. The threaded bulkhead connection 300 may isolate the mated threaded connection 309 from damage from the force generated by the gun section 210.

The internal shockwave and/or pressure spike event created by charges 204B firing inside of lower gun body 212B may impact the bulkhead connection 300 to move the bulkhead connector 330 uphole (towards the top of gun apparatus 34), shear the connector pins 396, and move the bulkhead wedge 350 uphole. The bulkhead connector 330 may move uphole so that the upper shoulder surface 306 of the upper gun body 212A contacts upper support shoulder 334 of the bulkhead connector 330. The contact area between the upper shoulder surface 306 and the upper support shoulder 334 receive the force of the shockwave and pressure spike. The contact stress of the upper shoulder surface 306 may be dependent on the amount of the shockwave and pressure spike attenuated away from the contact area as described below. The upward movement of the bulkhead connector 330 may also separate the support sleeve end surface 346 from lower seating shoulder 322. The movement of the bulkhead connector 330 may cause Gap A between upper support shoulder 334 and upper shoulder surface 306 to decrease to zero and Gap B measured between shoulder surface 316 and support shoulder 336 may increase. Likewise a Gap or separation, Gap C, may occur between support sleeve end surface 346 and lower seating shoulder 322. The bulkhead connector 330 may isolate the upper gun body 212A from the pressure spike from lower gun body 212B and the inward rush of ambient wellbore fluids outside of the upper gun body 212A with the upper seal 392 in sealing engagement with lower seal surface 318, lower seal 394 in sealing engagement with lower seal surface 318, and plug 399 in sealing engagement with equipment receptacle 337.

The shockwave may impact the bulkhead wedge 350 across the bottom surface 388 and end shoulder surface 364 and may shear the connector pins 396 and move the bulkhead wedge 350 uphole or towards the top of the gun apparatus 34. The bulkhead wedge 350 may be forced under support sleeve 340 so that the wedge surface 352 deforms the support sleeve 340 into the inner groove 320. The upward movement of the bulkhead wedge 350 and the subsequent deformation of the support sleeve 340 may attenuate the resultant force of the internal shockwave and pressure spike on the bulkhead connection 300. The shockwave may move the bulkhead wedge 350 upwards, toward the top of the gun assembly, until the wedge surface 352 deforms the support sleeve 340 to fill the inner groove 320. The deformation of support sleeve 340 into inner groove 320 expands the outer sleeve surface 342 and inner sleeve surface 344 of support sleeve 340 into the inner groove 320. The deformation of support sleeve 340 into inner groove 320 with the bulkhead wedge 350 swaged underneath into an interference fit transfers the shockwave into the lower gun body 212B, across the lower gun body thread 312, into the threaded connection 309, through the upper gun body thread 302, and into upper gun body 212A. The bulkhead wedge 350 swaged underneath the support sleeve 340 attenuates the shockwave and redirects the force of the shockwave away from the contact area of upper shoulder surface 306 and thereby reduces the contact stress applied to upper shoulder surface 306. The bulkhead wedge 350 may be swaged underneath the connector meaning an interference fit or force fit between inner sleeve surface 344 and wedge surface 352. The interference fit may keep the bulkhead wedge 350 attached to, or in contact with, the support sleeve 340. The Gap C measured between the support sleeve end surface 346 and lower seating shoulder 322 may increase in size.

The charge carrier 360 may deform from the near simultaneous firing of the charges 204B and the detonator cord 208. The charge carrier 360 may remain connected to the bulkhead wedge 350 or the force of the internal shockwave created by the simultaneous firing of the charges 204B may shear the screw 398 and separate the charge carrier 360 from the bulkhead wedge 350. Although the charge carrier 360 is illustrated as deformed charge carrier 360' with an accordion shape, the actual shape of the deformed charge carrier 360 may vary as the shockwave event may create a chaotic deformed shape.

Figure 5:
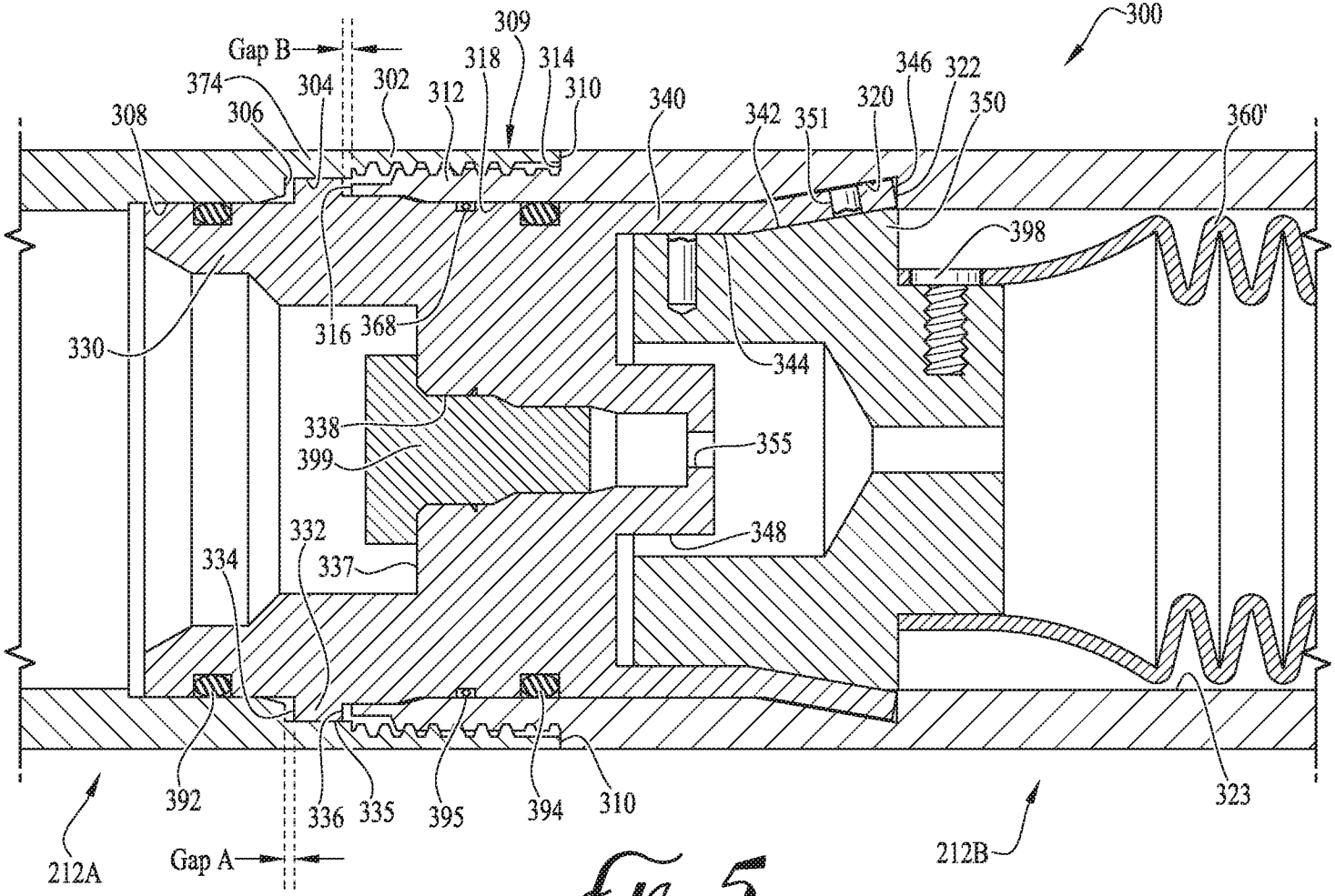
FIG. 5 is a cross-sectional view of an embodiment of a perforating gun apparatus after the upper gun section fires.

Turning now to FIG. 5, the bulkhead connection 300 may be reconfigured as shown after the second gun section 210 perforates the casing. The gun apparatus 34 may be moved to a second zone 40 by workstring 32 and the service personnel at surface may command the gun apparatus 34 to fire a second gun section 210. In this embodiment, the second gun section 210 is the upper gun section 210A. The upper gun body 212A of the upper gun section 210A may be uphole of the threaded bulkhead connection 300 and threadingly attached to the upper end portion. The charges 204A and detonator cord 208 may be fired simultaneously to perforate the casing 16 in a zone 40 in the well. The near simultaneous detonation of the charges 204A and detonator cord 208 create an internal shockwave and pressure spike event that moves the bulkhead connector 330 downhole or towards the bottom end of the gun apparatus 34.

The bulkhead connector 330 may remain sealingly engaged to the upper sealing surface 308 of the upper gun body thread 302 with upper seal 392. The threaded connection 309 of upper gun body thread 302 and lower gun body thread 312 may be isolated from the pressure spike event by upper seal 392. The bulkhead connector 330 may move downhole or towards the bottom of the tool assembly from the internal shockwave impacting the equipment receptacle 337 and plug 399 until support sleeve end surface 346 contacts lower seating shoulder 322. The deformation of support sleeve 340 shown in FIG. 3 may result in the full cross-section of material, the thickness of material between the outer sleeve surface 342 and inner sleeve surface 344, bearing the stress of the internal shockwave impact on the equipment receptacle 337 and plug 399. The deformed support sleeve 340 may attenuate the impact of the internal shockwave and pressure spike by transferring the resultant forces to the lower gun body 212B and preventing support shoulder 336 of the bulkhead connector 330 from contacting shoulder surface 316 of the lower gun body thread 312. The resulting movement may increase Gap A, the distance between upper shoulder surface 306 and upper support shoulder 334. The resulting movement may also decrease Gap B, the distance between shoulder surface 316 and support shoulder 336.

Bulkhead wedge 350 may remain connected to bulkhead connector 330 or the downward motion may cause the bulkhead wedge 350 to disengage from the bulkhead connector 330. The bulkhead wedge 350 may stay swaged underneath the outer sleeve surface 342 or may disengage to fall towards the bottom of the lower gun body 212B. Likewise, the downward motion may disconnect the deformed charge carrier 360' from the wedge 350.

Figure 6:
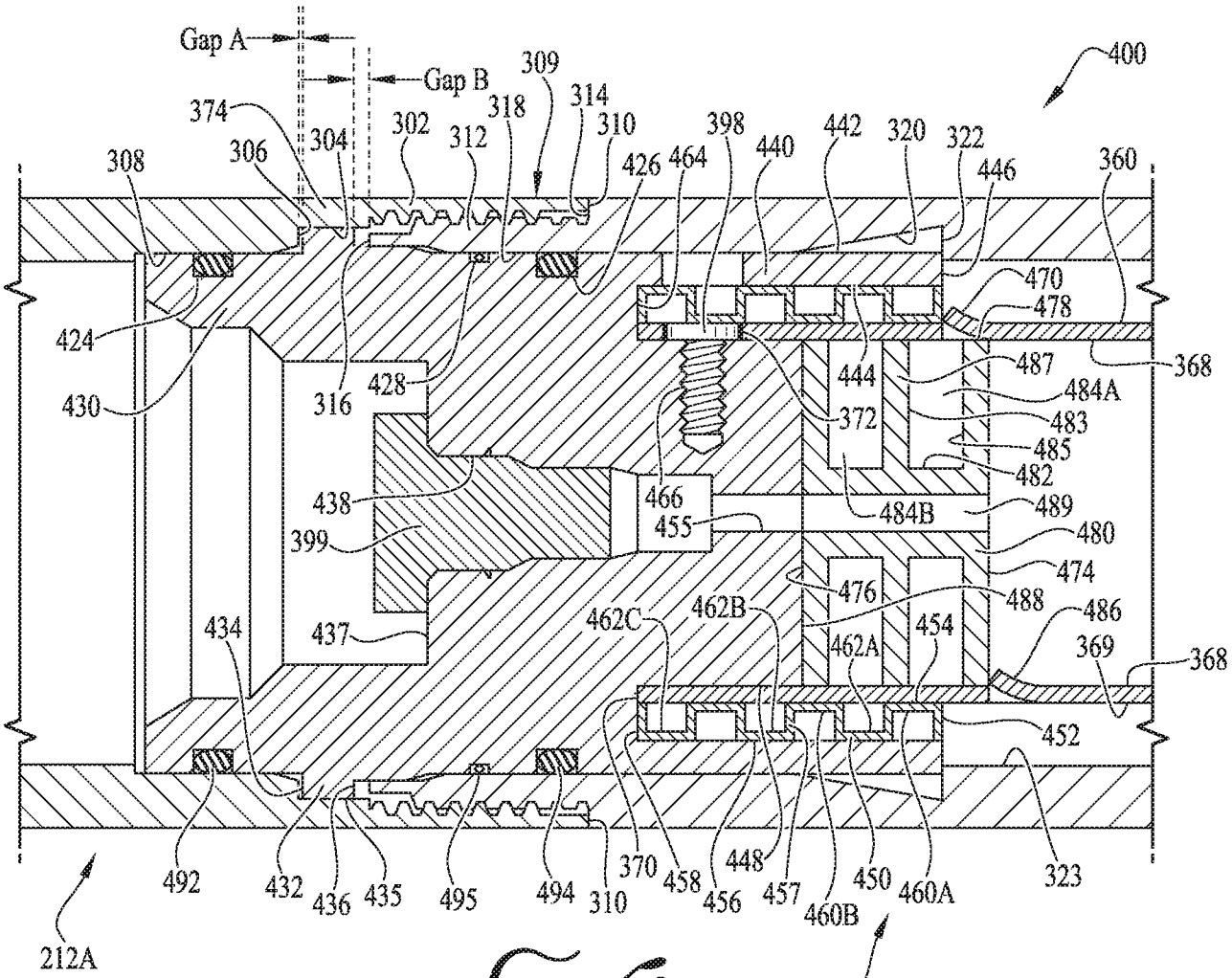
FIG. 6 is a cross-sectional view of an embodiment of a perforating gun apparatus comprising a shockwave attenuating connection.

FIG. 6 illustrates a cross-sectional view of an embodiment of the threaded bulkhead connection 400 configured to attenuate the internal shockwave created by the perforating gun sections. The upper gun body 212A may be threadingly attached to the upper end portion 200 and may be uphole of the threaded bulkhead connection 400. The threaded bulkhead connection 400 may include a bulkhead connector 430, upper gun body thread 302, lower gun body thread 312, shock absorber plug 480, annular absorber 450, and charge carrier 360. The upper gun body 212A may be threadingly connected to lower gun body 212B with threaded connection 309. The threaded connection 309 of upper gun body thread 302 may be threadingly mated to lower gun body thread 312 until upper thread surface 310 engages lower thread surface 314. The upper gun body thread 302 forms a gun body housing 374 that includes upper shoulder surface 306, inner surface 304, and upper sealing surface 308. The lower gun body thread 312 may include lower shoulder surface 316, lower seal surface 318, inner groove 320, and lower seating shoulder 322.

Bulkhead connector 430 may be cylindrical with an outer surface 435 and a support ring 432 having an upper support shoulder 434 and lower support shoulder 436. Bulkhead connector 430 may be installed inside gun body housing 374 with an allowance fit between outer surface 435 and inner surface 304 of upper gun body thread 302. The support ring 432 of the bulkhead connector 430 may be free to move axially inside gun body housing 374 between upper shoulder surface 306 and shoulder surface 316. The upper support shoulder 434 of the bulkhead connector 430 and upper shoulder surface 306 may be separated by Gap A. The lower support shoulder 436 of the bulkhead connector 430 and shoulder surface 316 may be separated by Gap B. The bulkhead connector 430 may have upper seal groove 424 with upper seal 492 in sealing engagement with upper sealing surface 308. The bulkhead connector 430 may have lower seal groove 426 with lower seal 494 in sealing engagement with lower seal surface 318. The bulkhead connector 430 may have grounding spring groove 428 with grounding spring 495 forming a conductive path between lower seal surface 318 of lower gun body 212B and grounding spring groove 428 of bulkhead connector 430. The bulkhead connector 430 may have an equipment receptacle 437 with an inner thread 438 and seal surface for detonators, isolators, and other equipment. For example, the plug 399 may represent isolators, detonators, and other equipment that sealingly attach to the equipment receptacle to isolate the upper gun body 212A from the lower gun body 212B and provide a communication path for the communication cable 209. In an alternate embodiment, the plug 399 may not seal, but pass a detonator cord 208 from the upper gun body 212A to the lower gun body 212B.

The bulkhead connector 430 may have support sleeve 440 with outer sleeve surface 442, inner sleeve surface 444, and support sleeve end surface 446. Outer sleeve surface 442 may be in sliding engagement with lower seal surface 318. The bulkhead connector 430 may have outer connector protrusion 448 for connection to charge carrier 360 and lower port 455 for passage of a detonator cord 208 or communication cable 209. The bulkhead connector 430 may have support sleeve end surface 446 engaged with lower seating shoulder 322 to support bulkhead connector 430 between upper gun body 212A and lower gun body 212B. Bulkhead connector 430 may be held in place with lower seating shoulder 322 in contact with support sleeve end surface 446 and Gap A between upper support shoulder 434 and upper shoulder surface 306. In an alternate embodiment, support sleeve 440 may be a separate part and threadingly attached, connected with fasteners, or slidingly connected to bulkhead connector 430.

The shock absorber plug 480 may be a cylinder with an outer surface 478, inner bore 489, and grooves 484. The shock absorber plug 480 may slidingly fit with an allowance fit between the outer surface 478 and the inner surface 368 of the charge carrier 360 with an inner tab 486 on the charge carrier bent inward towards the interior of the charge carrier 360 to hold it in place. The shock absorber plug 480 may have a front surface 476 and a bottom surface 474. The shock absorber plug 480 may have one or more grooves 484 formed in the outer surface 478 with an uphole side surface 483A, a downhole side surface 485A, and a bottom surface 482. The grooves 484 may be a rectangular cross-section with uphole side surface 483 and downhole side surface 485 perpendicular to the outer surface 478 and a bottom surface 482 parallel to the outer surface 478. Alternately, the groove 484 may be other shapes in the cross-section; e.g., V-shaped, U-shaped, or with curved uphole side surface 483 and downhole side surface 485. The shock absorber plug 480 may have a plurality of grooves along the outer surface 478 parallel to one another that form a series of radial walls, tabs, blades, or fins. The radial walls 487 may have the same wall thickness or may have wall thickness that varies from wall to wall. For example, the radial wall 487 wall thickness may increase from the front surface 476 to the bottom surface 474. Or alternately, the radial wall thickness may decrease from the front surface 476 to the bottom surface 474. Each radial wall 487 may be formed to deform, deflect, or fold at a given force generated by an internal shockwave or pressure spike. Alternately, the plurality of radial walls 487 may be formed to deform, deflect, or fold at a given force generated by a shockwave or pressure spike. Although the bottom surface 482 is shown as a flat bottom, the bottom surface may be curved. Although the shock absorber plug 480 shows groove 484A and groove 484B, the shock absorber plug 480 may have 1, 2, 3, 4, 5, 6, 7, 8, 9, 10, or more grooves. The shock absorber plug 480 may have an inner bore 489 to pass a detonator cord 208 or other cables through. Although, the shock absorber plug 480 is shown as one part, the shock absorber plug 480 may be made up of two or more parts.

The annular absorber 450 may be a cylinder with an outer surface 456, inner surface 454, bottom surface 452, and front surface 458. The annular absorber 450 may slidingly fit into the support sleeve 440 and onto the outer surface 369 of charge carrier 360 with an allowance fit. The front surface 458 of the annular absorber 450 may abut the end shoulder surface 464 of the bulkhead connector 430 and may be held in place with a bent tab 470 on the outer surface 369 of the charge carrier 360 bent outward towards the inner surface 323 of the lower gun body 212B to hold it in place. The annular absorber 450 may have one or more outside grooves 460 formed in the outer surface 456 with one or more inner grooves 462A formed along the inner surface 454. The annular absorber 450 may alternate grooves between an outside groove 460 and an inside groove 462 along the length of the part to form a corrugated shaped part. The grooves may be rectangular in cross-section to form a part with square or rectangular corrugated cross-section. The outside groove and inside groove may be V-shaped, U-shaped, semi-circular, or curved cross-section to form a part with alternating ridges, folds, wrinkles, or grooves. The corrugated walls 457 may be same thickness from bottom surface 452 to front surface 458. The corrugated walls 457 may have a thickness that varies, for example an increasing thickness or decreasing thickness from surface 453 to front surface 458. Each corrugated wall 457 may be formed to deform, deflect, or fold at a given force generated by a shockwave or pressure spike. Alternately, the plurality of corrugated walls 457 may be formed to deform, deflect, or fold at a given force generated by an internal shockwave or pressure spike. Although the annular absorber 450 shows outer groove 460A and outer groove 460B, the shock absorber plug 480 may have 1, 2, 3, 4, 5, 6, 7, 8, 9, 10, or more grooves. Although the annular absorber 450 shows inner groove 462A and inner groove 462B, the annular absorber 450 may have 1, 2, 3, 4, 5, 6, 7, 8, 9, 10, or more grooves. Although the annular absorber 450 is shown as one part, it may be made up of two or more parts.

The charge carrier 360 may be a cylinder with an outer surface 369, an inner surface 368, and an upper end surface 370. The inner surface 368 of charge carrier 360 slidingly fits onto the outer connector protrusion 448 of bulkhead connector 430. The upper end surface 370 may abut end shoulder surface 464. Bulkhead connector 430 may be attached to and support charge carrier 360 by screw 398. The upper end of the charge carrier may have one or more support holes 372 to receive the screw head of screw 398. The pin hole 466 may be threaded to receive screw 398. Although one screw 398 is shown, multiple screws 398 and support holes 372 may be located around the outer surface 369 of the charge carrier 360.

Figure 7:
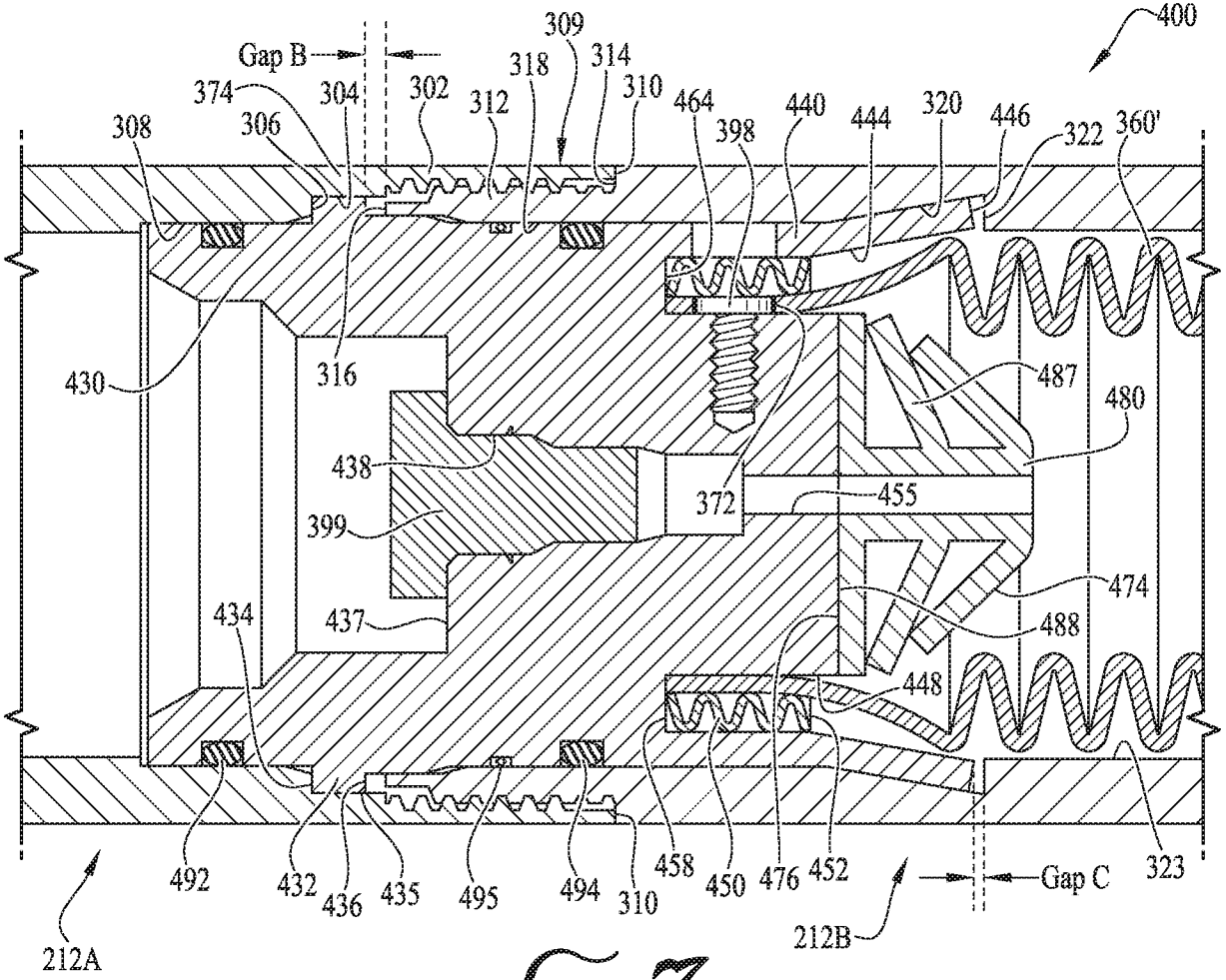
FIG. 7 is a cross-sectional view of an embodiment of a perforating gun apparatus after the lower gun section fires.

Turning now to FIG. 7, the charges 204B in the lower gun section 210B may be fired from a command given at surface by service personnel resulting in the threaded bulkhead connection 400 being reconfigured as shown. The near simultaneous firing of the charges 204B and the detonator cord 208 may cause an internal shockwave and a pressure spike from an inrush of wellbore fluids. The threaded bulkhead connection 400 may isolate the mated thread from damage from the internal shockwave, the pressure spike event, or both.

The internal shockwave and pressure spike event created by charges 204B firing inside of lower gun body 212B may impact the bulkhead connection 400 to move the bulkhead connector 430 uphole (towards the top of 34) so that the upper support shoulder 434 contacts the upper shoulder surface 306 of upper gun body 212A. The contact area between the upper shoulder surface 306 and the upper support shoulder 434 receive the force of the shockwave and pressure spike. The contact stress of the upper shoulder surface 306 may be dependent on the amount of the shockwave and pressure spike attenuated away from the contact area as described below. The movement of the bulkhead connector 430 may cause Gap A between upper support shoulder 434 and upper shoulder surface 306 to decrease to zero and Gap B measured between shoulder surface 316 and support shoulder 436 may increase. Likewise a gap or separation may occur between support sleeve end surface 446 and lower seating shoulder 322 shown on FIG. 7 as Gap C.

The internal shockwave may impact the bottom surface 474 of the shock absorber plug 480 and deform the shock absorber plug 480. The deformation of the shock absorber plug 480 attenuates the force of the shockwave on the bulkhead connector 430 and upper shoulder surface 306 of the upper gun body thread 302 at the threaded connection 309. Although the deformation of shock absorber plug 480 is shown with radial walls 487 deformed with angled walls, the deformation due to the shockwave may be chaotic and unique with every shockwave event. The deformation of shock absorber plug 480 is an illustration and not representative of the final shape and should not be limiting the scope of this disclosure in any way. Although the shock absorber plug 480 is illustrated with front surface 476 abutting end surface 488, the front surface 476 is not attached to end surface 488 and therefore the shock absorber plug 480 may separate or fall away from the bulkhead connector 430.

The internal shockwave may impact the bottom surface 452 of the annular absorber 450 and deform the annular absorber 450. The deformation of the annular absorber 450 attenuates the force of the internal shockwave on the bulkhead connector 430 and upper shoulder surface 306 of the upper gun body thread 302 at the threaded connection 309. Even though the deformation of annular absorber 450 is shown with groove walls collapsed and generally shaped curved groove walls, the deformation due to the internal shockwave may be chaotic and unique with every shockwave event. The deformation of annular absorber 450 is an illustration and not representative of the final shape and should not be limiting the scope of this disclosure in any way. Although the annular absorber 450 is illustrated with front surface 458 abutting end shoulder surface 464, the front surface 458 is not attached to end shoulder surface 464 and therefore the annular absorber 450 may separate or fall away from the bulkhead connector 430. The internal shockwave may impact the support sleeve 440 with an expansion force that deforms the support sleeve 440 into the inner groove 320 until the support sleeve 440 deforms to fill the inner groove 320. The deformation of support sleeve 440 into inner groove 320 expands the outer sleeve surface 442 and inner sleeve surface 444 of support sleeve 440 into the inner groove 320. The deformed support sleeve 440 may transfer the shockwave into the lower gun body 212B, across the lower gun body thread 312, into the threaded connection 309, through the upper gun body thread 302, and into upper gun body 212A. The deformed support sleeve 440 may attenuate the shockwave and redirects the force of the shockwave away from the contact area of upper shoulder surface 306 and thereby reduces the contact stress applied to upper shoulder surface 306. The Gap C measured between the support sleeve end surface 346 and lower seating shoulder 322 may increase in size.

The bulkhead connector 430 may isolate the threaded connection 309 from the pressure spike with the upper seal 492 in sealing arrangement with upper sealing surface 308 of the upper gun body 212A and with lower seal 494 in sealing engagement with lower seal surface 318 of the lower gun body 212B. The pressure spike event may transfer an upward force across the sealing engagement of the bulkhead connector 430 to upper support shoulder 434 and upper shoulder surface 306 of upper gun body 212A. The transfer of the upward force to the upper shoulder surface 306 may distribute the force into the upper gun body 212A and away from the threaded connection 309. The upper shoulder surface 306 and upper support shoulder 434 may come into contact so that Gap A, the distance between upper shoulder surface 306 and upper support shoulder 434, is zero. The uphole movement may also cause Gap B, the distance between shoulder surface 316 and support shoulder 436, to increase in size.

The charge carrier 360 may deform from the simultaneous firing of the charges 204B and the detonator cord 208. The charge carrier 360 may remain connected to the bulkhead connector 430 or the force of the internal shockwave created by the near simultaneous firing of the charges 204B may shear the screw 398 and separate the charge carrier 360 from the bulkhead connector 330. Although the charge carrier 360 is illustrated as deformed charge carrier 360' with an accordion shape, the actual shape of the deformed charge carrier 360 may vary as the shockwave event may create a chaotic deformed shape.

Figure 8:
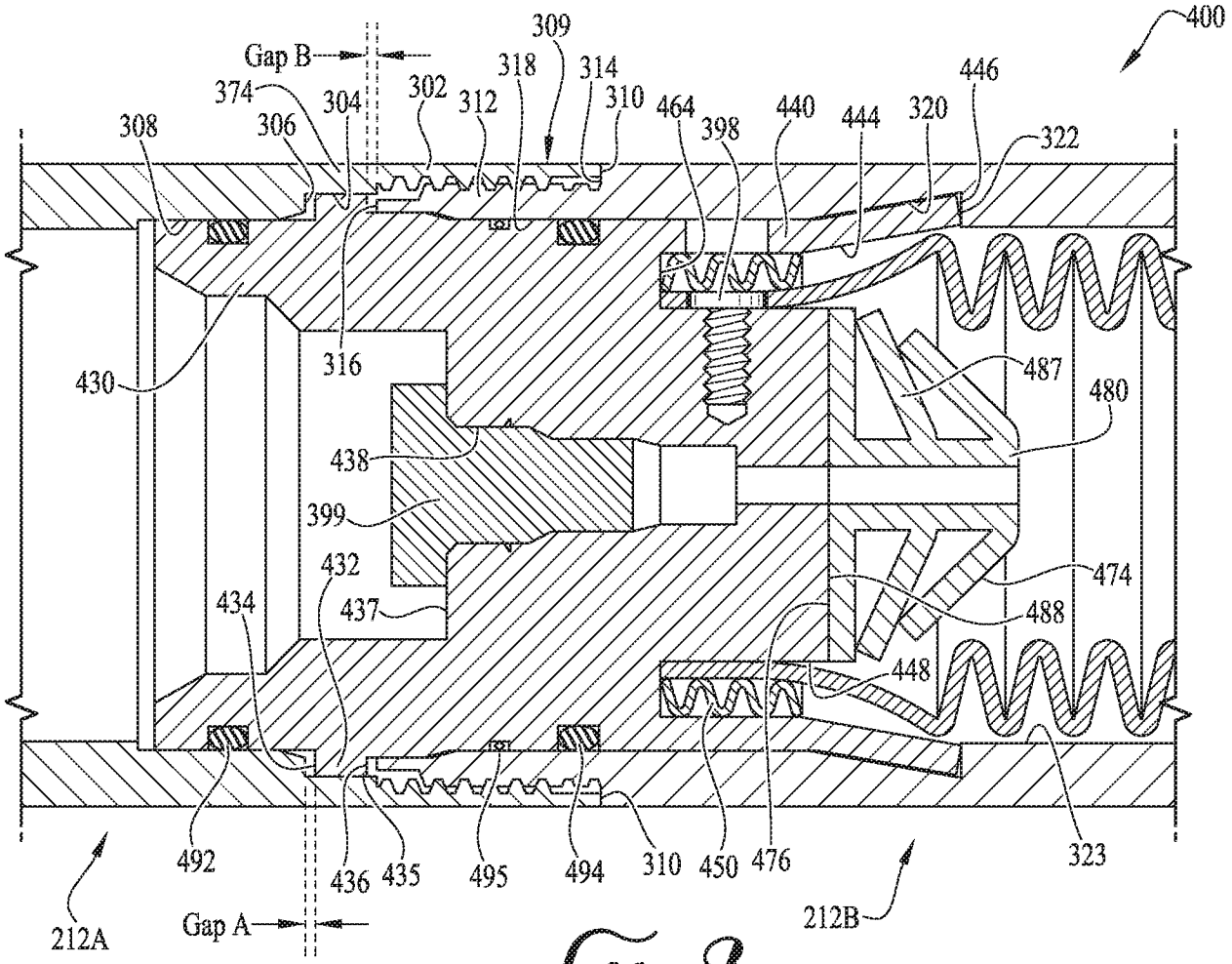
FIG. 8 is a cross-sectional view of an embodiment of a perforating gun apparatus after the upper gun section fires.

Turning now to FIG. 8, the threaded bulkhead connection 400 may be reconfigured as shown after the upper gun body 212A perforates the casing. The gun apparatus 34 may be moved to a second zone 40 by workstring 32 and the service personnel at surface may command the gun apparatus 34 to fire the upper gun section 210A. The upper gun body 212A may be uphole of the threaded bulkhead connection 400 and threadingly attached to the upper end portion. The charges 204A and detonator cord 208 may be fired simultaneously to perforate the casing 16 in a zone 40 in the well. The near simultaneous detonation of the charges 204A and detonator cord 208 create an internal shockwave and pressure spike event that moves the bulkhead connector 430 downhole or towards the bottom end of the gun apparatus 34.

The bulkhead connector 430 may remain sealingly engaged to the upper sealing surface 308 of the upper gun body thread 302 with upper seal 492. The upper gun body thread 302 and lower gun body thread 312 may be isolated from the pressure spike event by upper seal 492. The bulkhead connector 430 may move downhole or towards the bottom of the tool assembly from the internal shockwave impacting the equipment receptacle 437 and plug 399 until support sleeve end surface 446 contacts lower seating shoulder 322. The deformation of support sleeve 440 shown in FIG. 7 may result in the full cross-section of material, the thickness of material between the outer sleeve surface 442 and inner sleeve surface 444, bearing the stress of the internal shockwave impact and the pressure spike on the equipment receptacle 437 and plug 399. The deformed support sleeve 440 may transfer the force from the internal shockwave and the pressure spike to the lower gun body 212B and away from the threaded connection 309. The deformed support sleeve 440 may attenuate the impact of the internal shockwave and pressure spike by transferring the resultant forces to the lower gun body 212B and preventing support shoulder 436 of the bulkhead connector 430 from contacting shoulder surface 316 of the lower gun body thread 312. The resulting movement may increase Gap A, the measured distance between upper shoulder surface 306 and upper support shoulder 434. The resulting movement may also decrease Gap B, the measured distance between shoulder surface 316 and support shoulder 436. The downward motion may disconnect the deformed charged carrier 360' from the bulkhead connector 430.

In an embodiment, bulkhead connection 400 may have annular absorber 450, but not shock absorber plug 480. In an embodiment, bulkhead connection 400 may have shock absorber plug 480, but not annular absorber 450. In an embodiment, bulkhead connection 400 may not have annular absorber 450 or shock absorber plug 480.

Figure 9:
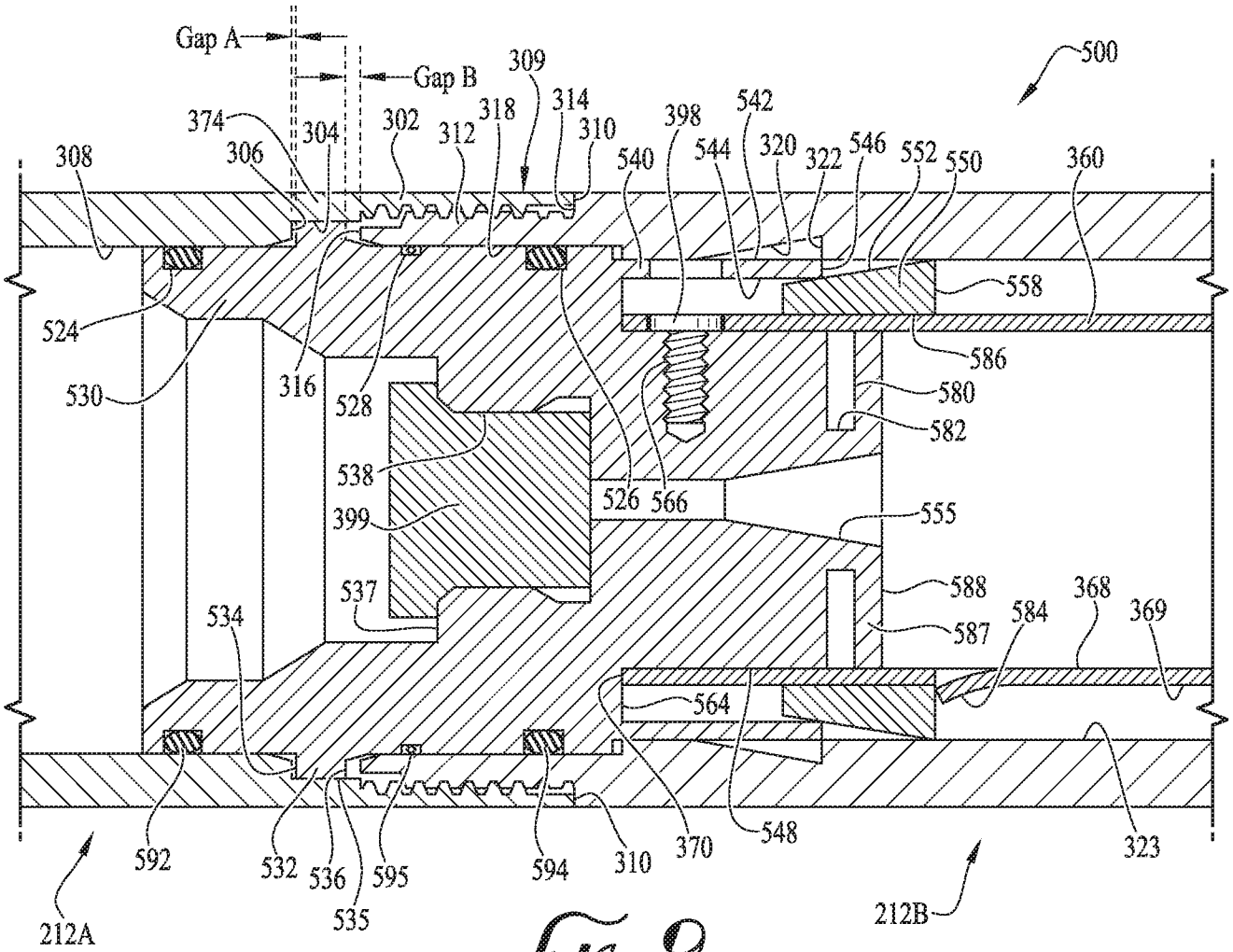
FIG. 9 is a cross-sectional view of an embodiment of a perforating gun apparatus comprising a shockwave attenuating connection.

FIG. 9 illustrates a cross-sectional view of an embodiment of the threaded bulkhead connection 500 configured to attenuate the internal shockwave created by the perforating gun sections. The upper gun body 212A may be threadingly attached to the upper end portion 200 and may be uphole of the threaded bulkhead connection 500. The threaded bulkhead connection 500 may include a bulkhead connector 530, slim wedge 550, upper gun body thread 302, lower gun body thread 312, and charge carrier 360. The upper gun body 212A may be threadingly connected to lower gun body 212B with threaded connection 309. The threaded connection 309 of upper gun body thread 302 may be threadingly mated to lower gun body thread 312 until upper thread surface 310 engages lower thread surface 314. The upper gun body thread 302 forms a gun body housing 374 that includes upper shoulder surface 306, inner surface 304, and upper sealing surface 308. The lower gun body thread 312 may include lower shoulder surface 316, lower seal surface 318, inner groove 320, and lower seating shoulder 322.

Bulkhead connector 530 may be cylindrical with an outer surface 535 and a support ring 532 having an upper support shoulder 534 and lower support shoulder 536. Bulkhead connector 530 may be installed inside gun body housing 374 with an allowance fit between outer surface 535 and inner surface 304 of upper gun body thread 302. The support ring 532 of the bulkhead connector 530 may be free to move axially inside gun body housing 374 between and shoulder surface 316. The upper support shoulder 534 of the bulkhead connector 530 and upper shoulder surface 306 may be separated by Gap A. The lower support shoulder 536 of the bulkhead connector 530 and shoulder surface 316 may be separated by Gap B. The bulkhead connector 530 may have upper seal groove 524 with upper seal 592 in sealing engagement with upper sealing surface 308 of upper gun body 212A. The bulkhead connector 530 may have lower seal groove 526 with lower seal 594 in sealing engagement with lower seal surface 318 of lower gun body 212B. The bulkhead connector 530 may have grounding spring groove 528 with grounding spring 595 forming a conductive path between lower seal surface 318 of lower gun body 212B and grounding spring groove 528 of bulkhead connector 530. The bulkhead connector may have an equipment receptacle 537 with an inner thread 538 and seal surface for detonators, isolators, and other equipment. For example, the plug 399 may represent isolators, detonators, and other equipment that sealingly attach to the equipment receptacle to isolate the upper gun body 212A from the lower gun body 212B and provide a communication path for the communication cable 209. In an alternate embodiment, the plug 399 may not seal, but pass a detonator cord 208 from the upper gun body 212A to the lower gun body 212B.

The bulkhead connector may have support sleeve 540 with outer sleeve surface 542, inner sleeve surface 544, and support sleeve end surface 546. Outer sleeve surface 542 may be in sliding engagement with lower seal surface 318. The bulkhead connector 530 may have outer connector protrusion 548 for engagement with charge carrier 360 and lower port 555 for passage of a communication cable 209 or a detonator cord 208. A shock groove 580 may be formed on the outer connector protrusion 548 of the outer connector protrusion 548 proximate to the end surface 588. The shock groove 580 may have a rectangular cross-section with a flat bottom surface 582. Alternatively, the shock groove 580 may have a V-shape, U-shape, or curved with a bottom surface 582 that may be curved or shaped like a vee. In an alternate embodiment, the bulkhead connector 530 may have two or more shock grooves 580 spaced parallel along the outer connector protrusion 548 forming radial walls 587 between the shock grooves 580 beginning proximate the end surface 588. The radial walls 587 may have the same wall thickness or may have wall thickness that varies from wall to wall. For example, the radial wall 587 wall thickness may increase from the end surface 588 to the annular end surface 564. Or alternately, the radial wall thickness may decrease from the end surface 588 to the annular end surface 564. Each radial wall 587 may be formed to deform, deflect, or fold at a given force generated by an internal shockwave or pressure spike. Alternately, the plurality of radial walls 587 may be formed to deform, deflect, or fold at a given force generated by an internal shockwave or pressure spike. The bulkhead connector 530 may have support sleeve end surface 546 engaged with lower seating shoulder 322 to support bulkhead connector 530 between upper gun body 212A and lower gun body 212B. Bulkhead connector 530 may be held in place by contacting lower seating shoulder 322 with support sleeve end surface 546 and Gap A between upper support shoulder 534 and upper shoulder surface 306. In an alternate embodiment, support sleeve 540 may be a separate part and threadingly attached, connected with fasteners, or slidingly connected to bulkhead connector 530.

The charge carrier 360 may be cylindrical shape with an outer surface 369 and an inner surface 368. The charge carrier 360 slidingly fits onto the outer connector protrusion 548 and the upper end surface 370 abuts annular end surface 564. Bulkhead connector 530 may be attached to and support charge carrier 360 by screw 398 installed in support hole 372. The upper end of the charge carrier 360 may have one or more support holes 372 to receive the screw head of screw 398. The pin hole 566 may be threaded to receive screw 398. Although one screw 398 is shown, multiple screws 398 and support holes 372 may be located around the outer surface 369 of the charge carrier 360.

The slim wedge 550 may be generally shaped like a cylinder with a frustoconical upper surface 552, an inner surface 586, and an end surface 558. The slim wedge 550 slidingly fits onto the outer surface 369. The frustoconical upper surface of the slim wedge 550 may abut the support sleeve end surface 546 of support sleeve 540. A tab 584 may be bent outward from the outer surface of the charge carrier 360 to hold the slim wedge 550 in place.

Figure 10:
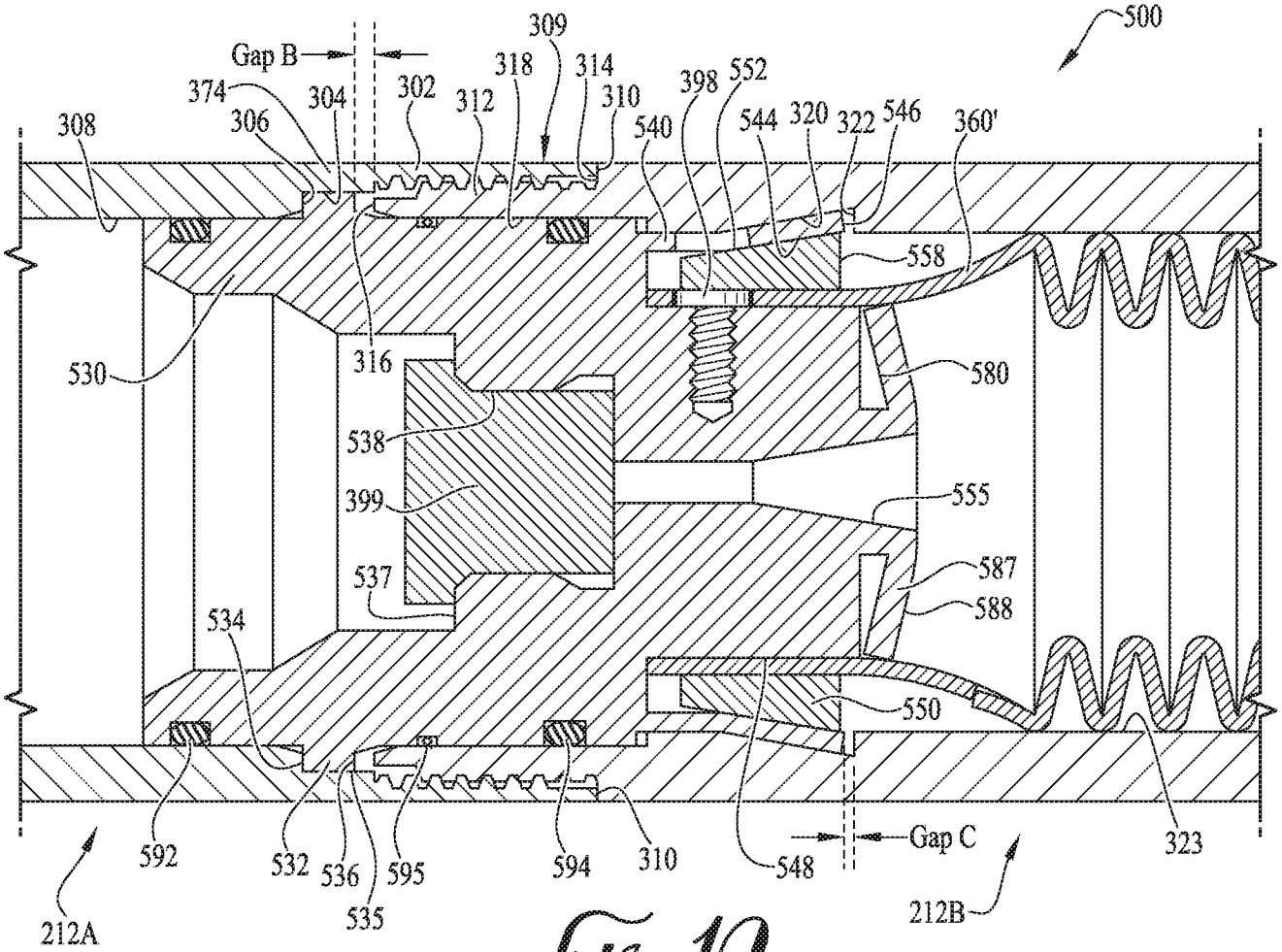
FIG. 10 is a cross-sectional view of an embodiment of a perforating gun apparatus after the lower gun section fires.

Turning now to FIG. 10, the charges 204B in the lower gun section 210B may be fired from a command given at the surface by service personnel resulting in the threaded bulkhead connection 500 being reconfigured as shown. The near simultaneous firing of the charges 204B and the detonator cord 208 may cause an internal shockwave and a pressure spike from an inrush of wellbore fluids. The threaded bulkhead connection 500 may isolate the mated thread from damage from the internal shockwave, the pressure spike event, or both.

The internal shockwave and pressure spike event created by charges firing inside of lower gun body 212B may impact the threaded bulkhead connection 500 to move the bulkhead connector 530 and slim wedge 550 uphole (towards the top of 34). The upward movement of the bulkhead connector 530 may cause upper support shoulder 534 to contact the upper shoulder surface 306 of the upper gun body 212A. The contact area between the upper shoulder surface 306 and the upper support shoulder 534 receive the force of the shockwave and pressure spike. The contact stress of the upper shoulder surface 306 may be dependent on the amount of the shockwave and pressure spike attenuated away from the contact area as described below. The movement of the threaded bulkhead connection 500 may cause Gap A between upper support shoulder 534 and upper shoulder surface 306 to decrease to zero and Gap B measured between shoulder surface 316 and support shoulder 536 may increase. Likewise a separation called Gap C may occur between support sleeve end surface 546 and lower seating shoulder 322.

The internal shockwave may impact the end surface 588 of the bulkhead connector 530 and deform the shock groove 580 and radial wall 587. The deformation of shock groove 580 and radial wall 587 may attenuate the force of the internal shockwave on the bulkhead connector 530 and the threaded connection. The radial wall 587 may also deform as the pressure spike event transfers an upward force across the sealing engagement of the bulkhead connector 530. The connector may be sealingly engaged with lower gun body thread 312 upper sealing surface 308 by upper seal 592 and lower seal surface 318 by lower seal 594.

The internal shockwave may impact the slim wedge 550 across the end surface 558 and move the slim wedge 550 uphole or towards the top of the gun apparatus 34. The upper shoulder surface 306 and upper support shoulder 534 may come into contact so that Gap A, the distance between upper shoulder surface 306 and upper support shoulder 534, is zero. The slim wedge 550 may be forced under support sleeve 540 until the frustoconical upper surface 552 deforms the support sleeve 540 into the inner groove 320. The slim wedge 550 may continue to move upwards, toward the top of the gun assembly, until the support sleeve 540 deforms to fill the inner groove 320. The deformation of support sleeve 540 into inner groove 320 may attenuate the force of the internal shockwave as the outer sleeve surface 542 and inner sleeve surface 544 of support sleeve 540 expands into the inner groove 320. The slim wedge 550 swaged underneath the deformed support sleeve 540 with an interference fit transfers the shockwave into the lower gun body 212B, across the lower gun body thread 312, into the threaded connection 309, through the upper gun body thread 302, and into upper gun body 212A. The slim wedge 550 swaged underneath the support sleeve 540 attenuates the shockwave and redirects the force of the shockwave away from the contact area of upper shoulder surface 306 and thereby reduces the contact stress applied to upper shoulder surface 306. The slim wedge 550 may be swaged underneath the support sleeve 540, meaning an interference fit or force fit, between inner sleeve surface 544 and frustoconical upper surface 552. The interference fit may keep the slim wedge 550 attached to or in contact with the bulkhead connector 530. The Gap C measured between the support sleeve end surface 546 and lower seating shoulder 322 may increase in size.

The bulkhead connector 530 may isolate the threaded connection from the pressure spike with the upper seal 592 in sealing arrangement with upper sealing surface 308 of upper gun body 212A and with lower seal 594 in sealing engagement with lower seal surface 318 of lower gun body 212B. The pressure spike event may transfer an upward force across the sealing engagement of the bulkhead connector 530 to upper support shoulder 534 and upper shoulder surface 306 of upper gun body 212A. The transfer of the upward force to the upper shoulder surface 306 may distribute the force into the upper gun body 212A and away from the threaded connection. The upper shoulder surface 306 and upper support shoulder 534 may come into contact so that Gap A, the distance between upper shoulder surface 306 and upper support shoulder 534, is zero. The uphole movement may also cause Gap B, the distance between shoulder surface 316 and support shoulder 536, to increase in size.

The charge carrier 360 may deform from the simultaneous firing of the charges 204B and the detonator cord 208. The charge carrier 360 may remain connected to the bulkhead connector 530 or the force of the internal shockwave created by the near simultaneous firing of the charges 204B and the detonator cord 208 may shear the screw 398 and separate the charge carrier 360 from the bulkhead connector 530. Although the charge carrier 360 is illustrated as deformed charge carrier 360' with an accordion shape, the actual shape of the deformed charge carrier 360' may vary as the event may create a chaotic deformed shape.

Figure 11:
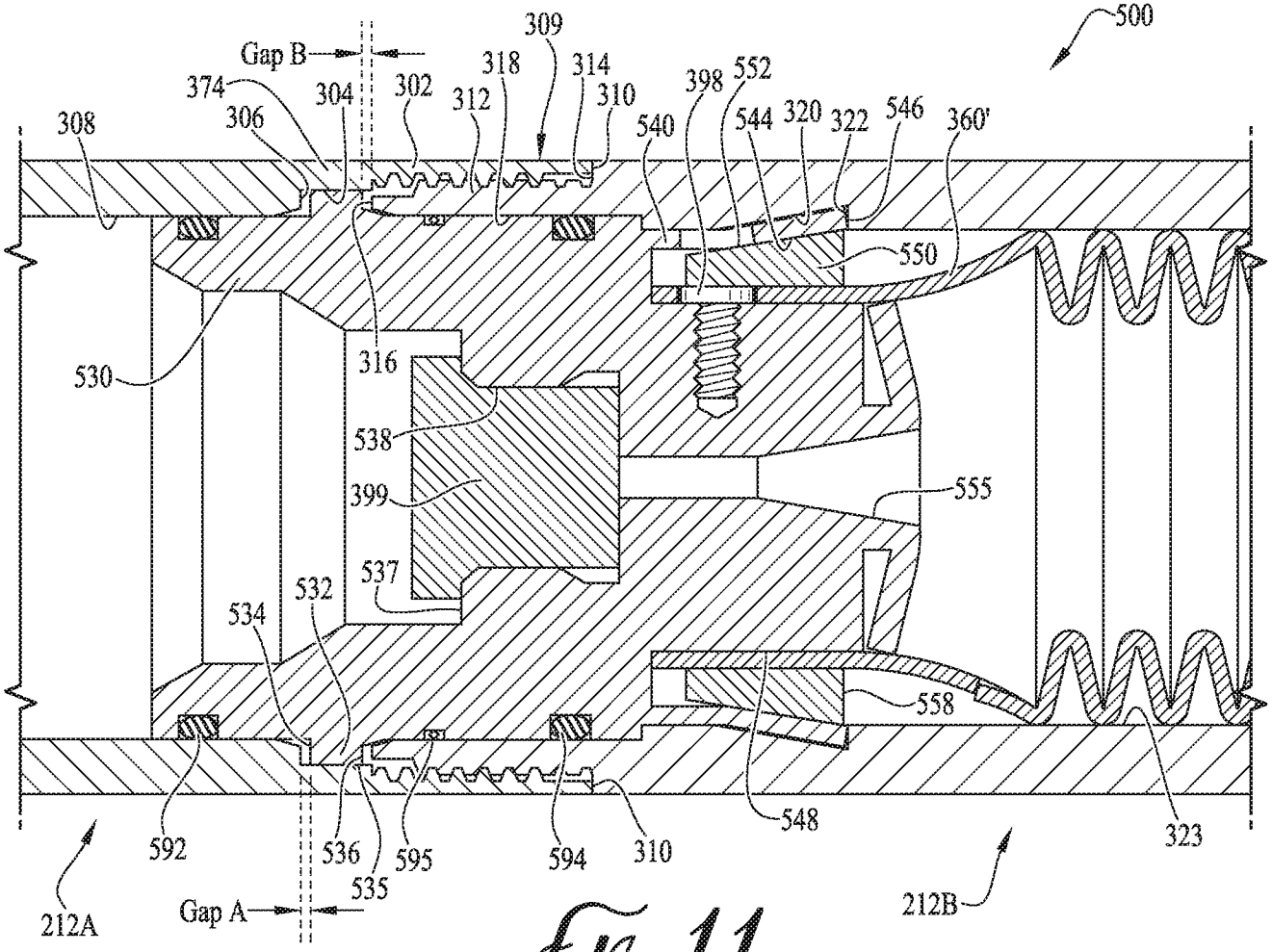
FIG. 11 is a cross-sectional view of an embodiment of a perforating gun apparatus after the upper gun section fires.

Turning now to FIG. 11, the threaded bulkhead connection 500 may be reconfigured as shown after the upper gun body 212A perforates the casing. The gun apparatus 34 may be moved to a second zone 40 by workstring 32 and the service personnel at surface may command the gun apparatus 34 to fire the upper gun section 210A. The upper gun body 212A may be uphole of the threaded bulkhead connection 500 and threadingly attached to the upper end portion. The charges 204A and detonation cord 208 may be fired simultaneously to perforate the casing 16 in a zone 40 in the well. The near simultaneous detonation of the charges 204A and detonation cord 208 create an internal shockwave and pressure spike event that moves the bulkhead connector 530 downhole or towards the bottom end of the gun apparatus 34.

The bulkhead connector 530 may be sealingly engaged to the upper sealing surface 308 of the upper gun body thread 302 with upper seal 592. The threaded connection of upper gun body thread 302 and lower gun body thread 312 may be isolated from the pressure spike event by upper seal 592 and lower seal 594. The bulkhead connector 530 may move downhole or towards the bottom of the tool assembly from the internal shockwave impacting the equipment receptacle 537 and plug 399 until support sleeve end surface 546 contacts lower seating shoulder 322. The deformation of support sleeve 540 shown in FIG. 10 may result in the full cross-section of material, the thickness of material between the outer sleeve surface 542 and inner sleeve surface 544, bearing the stress of the internal shockwave impact and the pressure spike on the equipment receptacle 537. The deformed support sleeve 540 may transfer the force from the internal shockwave and pressure spike to the lower gun body 212B and away from the threaded connection. The deformed support sleeve 540 may attenuate the impact of the internal shockwave and pressure spike by transferring the resultant forces to the lower gun body 212B and preventing support shoulder 536 of the bulkhead connector 530 from contacting shoulder surface 316 of the lower gun body thread 312. The resulting movement may increase Gap A, the measured distance between upper shoulder surface 306 and upper support shoulder 534. The resulting movement may also decrease Gap B, the measured distance between shoulder surface 316 and support shoulder 536.

Slim wedge 550 may remain connected to bulkhead connector 530 or the downward motion may cause the slim wedge 550 to disengage from the bulkhead connector 530. The slim wedge 550 may be swaged underneath the connector, meaning an interference fit or force fit, between inner sleeve surface 544 and frustoconical upper surface 552. Likewise, the downward motion may disconnect the deformed charge carrier 360' from the connector 530.

Figure 12:
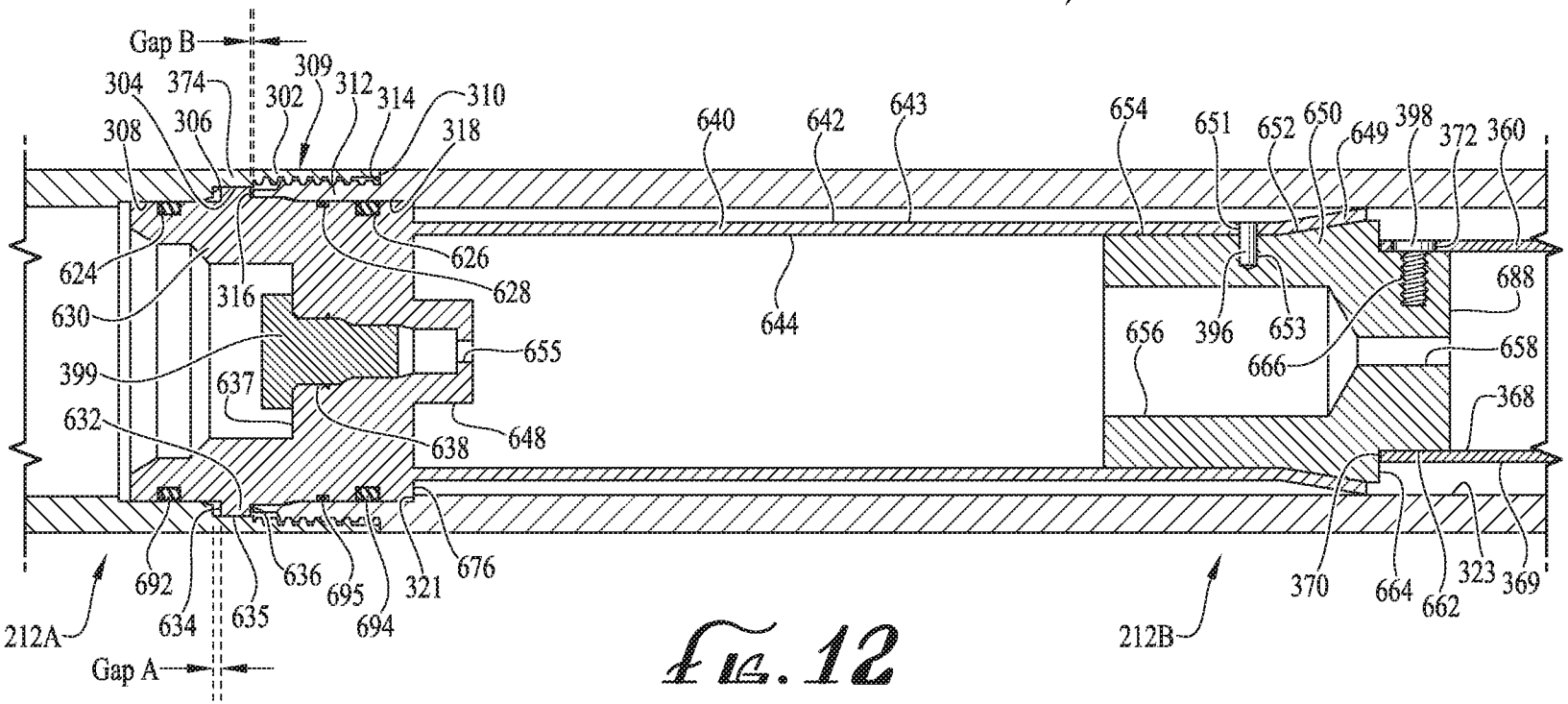
FIG. 12 is a cross-sectional view of an embodiment of a perforating gun apparatus comprising a shockwave attenuating connection.

FIG. 12 illustrates a cross-sectional view of an embodiment of the threaded bulkhead connection 600 configured to attenuate the internal shockwave created by the perforating gun sections. The upper gun body 212A may be threadingly attached to the upper end portion 200 and may be uphole of the threaded bulkhead connection 600. The threaded bulkhead connection 600 may comprise a bulkhead connector 630, bulkhead wedge 650, upper gun body thread 302, lower gun body thread 312, and charge carrier 360. The upper gun body 212A may be threadingly connected to lower gun body 212B with threaded connection 309. The threaded connection 309 of upper gun body thread 302 may be threadingly mated to lower gun body thread 312 until upper thread surface 310 engages lower thread surface 314. The upper gun body thread 302 forms a gun body housing 374 that includes upper shoulder surface 306, inner surface 304, and upper sealing surface 308. The lower gun body thread 312 may include lower shoulder surface 316, lower seal surface 318, and support shoulder 321.

Bulkhead connector 630 may be attached to and support bulkhead wedge 650 and charge carrier 360. Bulkhead connector 630 may be connected to bulkhead wedge 650 by connector pin 396. Charge carrier 360 may be connected to bulkhead wedge 650 by screw 398.

Bulkhead connector 630 may be cylindrical with an outer surface 635 and a support ring 632 having an upper support shoulder 634 and lower support shoulder 636. Bulkhead connector 630 may be installed inside gun body housing 374 with an allowance fit between outer surface 635 and inner surface 304 of upper gun body thread 302. The support ring 632 of the bulkhead connector 630 may be free to move axially inside gun body housing 374 between upper shoulder surface 306 and shoulder surface 316. The upper support shoulder 634 of the bulkhead connector 630 and upper shoulder surface 306 may be separated by Gap A. The lower support shoulder 636 of the bulkhead connector 630 and shoulder surface 316 of the may be separated by Gap B. The end surface 676 of the bulkhead connector 630 may abut the support shoulder 321 of the lower gun body thread 312. The bulkhead connector 630 may have upper seal groove 624 with upper seal 692 in sealing engagement with upper sealing surface 308 of the upper gun body 212A. The bulkhead connector 630 may have lower seal groove 626 with lower seal 694 in sealing engagement with lower seal surface 318 of lower gun body 212B. The bulkhead connector 630 may allow wellbore fluid to enter the threaded connection 309 of upper gun body thread 302 and lower gun body thread 312 while isolating the upper gun section 210A and lower gun section 210B from wellbore fluids with upper seal 692 in sealing engagement with upper sealing surface 308 and lower seal 694 in sealing engagement with lower seal surface 318. The bulkhead connector 630 may have grounding spring groove 628 with grounding spring 695 forming an electrically conductive path between lower seal surface 318 of lower gun body 212B and grounding spring groove 628 of bulkhead connector 630. The bulkhead connector 630 may have an equipment receptacle 637 with an inner thread 638 and seal surface for detonators, isolators, and other equipment. For example, the plug 399 may represent isolators, detonators, and other equipment that sealingly attach to the equipment receptacle 637 to isolate the upper gun body 212A from the lower gun body 212B and provide a communication path for the communication cable 209. In an alternate embodiment, the plug 399 may not seal, but pass a detonator cord 208 from the upper gun body 212A to the lower gun body 212B.

The bulkhead connector 630 may have support sleeve 640 with outer sleeve surface 642, inner sleeve surface 644, outer sleeve coating 643, and sleeve end entry cone 649. The outer sleeve coating 643 may be a polymer coating, an elastomer coating, a rubberized coating, or may include sand or grit particles. The sleeve end entry cone 649 may centralize the bulkhead wedge 650 within the lower gun body 212B. The bulkhead connector 630 may have inner connector protrusion 648 for engagement with associated equipment and lower port 655 for passage of a communication cable 111 and/or detonator cord 208. The bulkhead connector 630 may have end surface 676 engaged with support shoulder 321 to support bulkhead connector 630 between upper gun body 212A and lower gun body 212B. In an alternate embodiment, support sleeve 640 may be a separate part and threadingly attached, connected with fasteners, or slidingly connected to bulkhead connector 630.

The bulkhead wedge 650 may be held in place by connector pin 396 installed in support sleeve hole 651 and wedge hole 653. Connector pin 396 may be made from a material designed to shear when subjected to a specified load. The connector pin 396 may comprise brass, stainless steel, annealed steel, nickel steel, or any other shearable material known to those in the arts. The bulkhead wedge 650 may be a cylinder with an outer surface 654 in sliding engagement with inner sleeve surface 644 and a wedge surface 652 that may be frustoconical in shape. The bulkhead wedge 650 may have an inner surface 656 and a cable port 658. The lower end of the bulkhead wedge 650 may have a lower outer surface 662, an end shoulder surface 664, and a lower pin hole 666.

The charge carrier 360 may be a cylinder with an outer surface 369, an inner surface 368, and an upper end surface 370. The upper end of the charge carrier may have one or more support holes 372 to receive the screw head of screw 398. The pin hole 666 may be threaded to receive screw 398.

The charge carrier 360 may be connected to the bulkhead wedge 650 by screw 398.

The inner surface 368 of charge carrier 360 slidingly fits onto the outer surface 662 of bulkhead wedge 650. The upper end surface 370 may abut end shoulder surface 664. The screw 398 may fit into support hole 372. Although one screw 398 is shown, multiple screws 398 and support holes 372 may be located around the outer surface 369 of the charge carrier 360.

Figure 13:
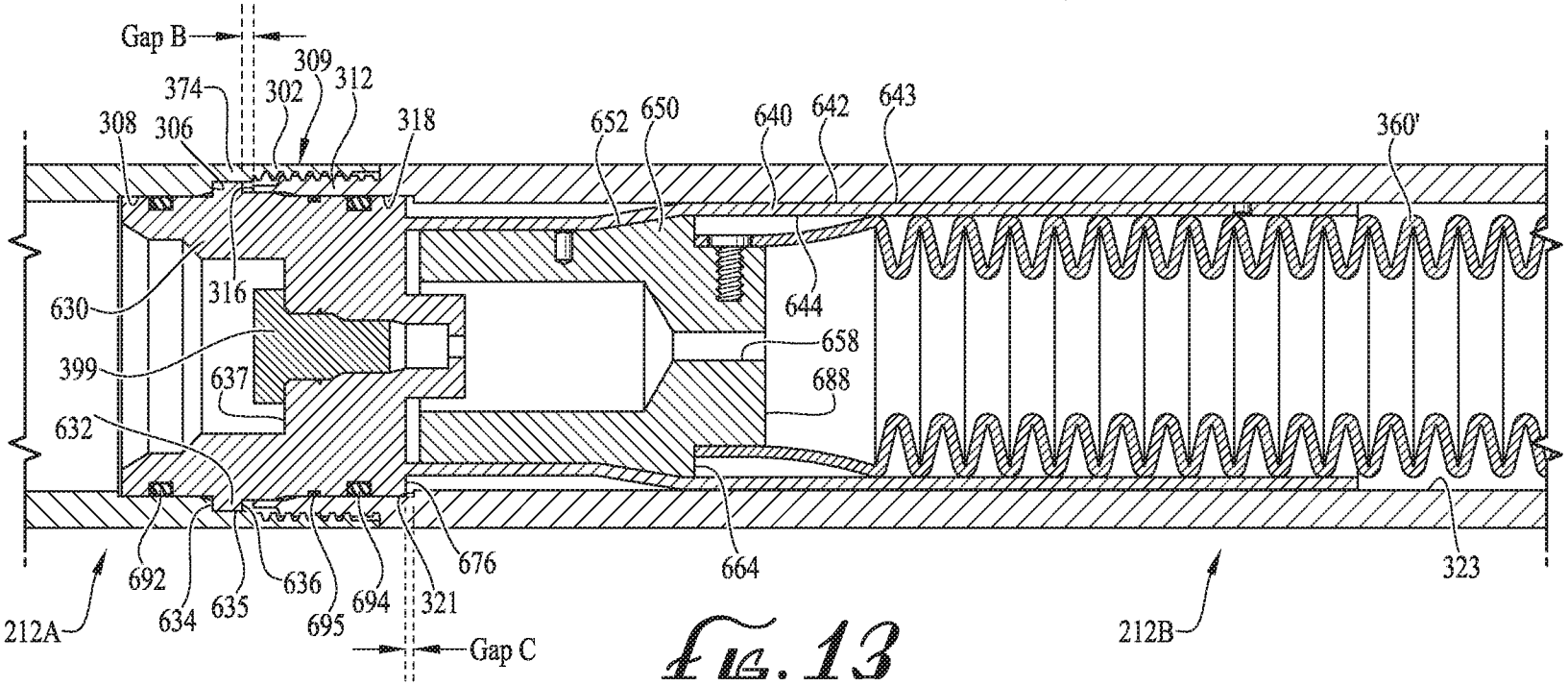
FIG. 13 is a cross-sectional view of an embodiment of a perforating gun apparatus after the lower gun section fires.

Turning now to FIG. 13, the charges 204B in the lower gun section 210B may be fired from a command given at surface by service personnel resulting in the threaded bulkhead connection 600 being reconfigured as shown. The near simultaneous firing of the charges and the detonator cord may cause an internal shockwave and a pressure spike from an inrush of wellbore fluids. The threaded bulkhead connection 600 may isolate the mated threaded connection 309 from damage from the shockwave, the instantaneous pressure event, or both.

The internal shockwave and pressure spike event created by charges 204B firing inside of lower gun body 212B may impact the bulkhead connection 600 to move the bulkhead connector 630 uphole (towards the top of gun apparatus 34), shear the connector pins 396, and move the bulkhead wedge 650 uphole. The bulkhead connector 630 may move uphole so that the upper shoulder surface 306 of the upper gun body 212A contacts upper support shoulder 634 of the bulkhead connector 630. The contact area between the upper shoulder surface 306 and the upper support shoulder 634 receives the force of the shockwave and pressure spike. The contact stress of the upper shoulder surface 306 may be dependent on the amount of the shockwave and pressure spike attenuated away from the contact area as described below. The movement of the bulkhead connector 630 may cause Gap A between upper support shoulder 634 and upper shoulder surface 306 to decrease to zero and Gap B measured between shoulder surface 316 and support shoulder 636 may increase. Likewise a Gap or separation, Gap C, may occur between end surface 676 and support shoulder 321. The bulkhead connector 630 may isolate the upper gun body 212A from the pressure spike from lower gun body 212B and the inward rush of ambient wellbore fluids outside of the upper gun body 212A with the upper seal 692 in sealing engagement with lower seal surface 318, lower seal 694 in sealing engagement with lower seal surface 318, and plug 399 in sealing engagement with equipment receptacle 337.

The shockwave may impact the bulkhead wedge 650 across the bottom surface 688 and end shoulder surface 664 and may shear the connector pins 396 and move the bulkhead wedge 650 uphole or towards the top of the gun apparatus 34. The bulkhead wedge 650 may be forced under support sleeve 640 so that the wedge surface 652 deforms the support sleeve 640 into contact with the inner surface 323 of the lower gun body 212B. The upward movement of the bulkhead wedge 650 and the subsequent deformation of the support sleeve 640 may attenuate the resultant force of the internal shockwave and pressure spike on the threaded bulkhead connection 600. The deformed support sleeve 640 with the expanded the outer sleeve surface 642 and inner sleeve surface 644 may remain deformed and in contact with the inner surface 323. The outer sleeve coating 643 may be compressed between the outer sleeve surface 642 and the inner surface 323 of the lower gun body 212B and increase the frictional force of the resultant contact stress between the support sleeve 640 and the lower gun body 212B. The bulkhead wedge 650 may be swaged underneath the deformed support sleeve 640 with an interference fit that transfers the shockwave into the lower gun body 212B, across the lower gun body thread 312, into the threaded connection 309, through the upper gun body thread 302, and into upper gun body 212A. The bulkhead wedge 650 swaged underneath the support sleeve 640 attenuates the shockwave and redirects the force of the shockwave away from the contact area of upper shoulder surface 306 and thereby reduces the contact stress applied to upper shoulder surface 306. The bulkhead wedge 650 may be swaged underneath the support sleeve 640 meaning an interference fit or force fit between inner sleeve surface 644 and wedge surface 652. The interference fit may keep the bulkhead wedge 650 attached to, or in contact with, the support sleeve 640. The Gap C measured between the end surface 676 and support shoulder 321 may increase in size.

The charge carrier 360 may deform from the near simultaneous firing of the charges 204B and the detonator cord 208. The charge carrier 360 may remain connected to the bulkhead wedge 650 or the force of the internal shockwave created by the simultaneous firing of the charges 204B may shear the screw 398 and separate the charge carrier 360 from the bulkhead wedge 650. Although the charge carrier 360 is illustrated as deformed charge carrier 360' with an accordion shape, the actual shape of the deformed charge carrier 360 may vary as the shockwave event may create a chaotic deformed shape.

In an alternate embodiment, the plug 399 may not seal, but pass a detonation cord 208 between the upper gun body 212A and lower gun body 212B. In this embodiment, the lower gun section 210B and upper gun section 210A may be fired nearly simultaneously. The threaded bulkhead connection 600 may be reconfigured as described above. The shockwave from the lower gun section 210B may be attenuated with the movement of the wedge 650 as described above. The inrush of wellbore fluids may pass through the plug 399 from the lower gun body 212B to the upper gun body 212A.

Figure 14:
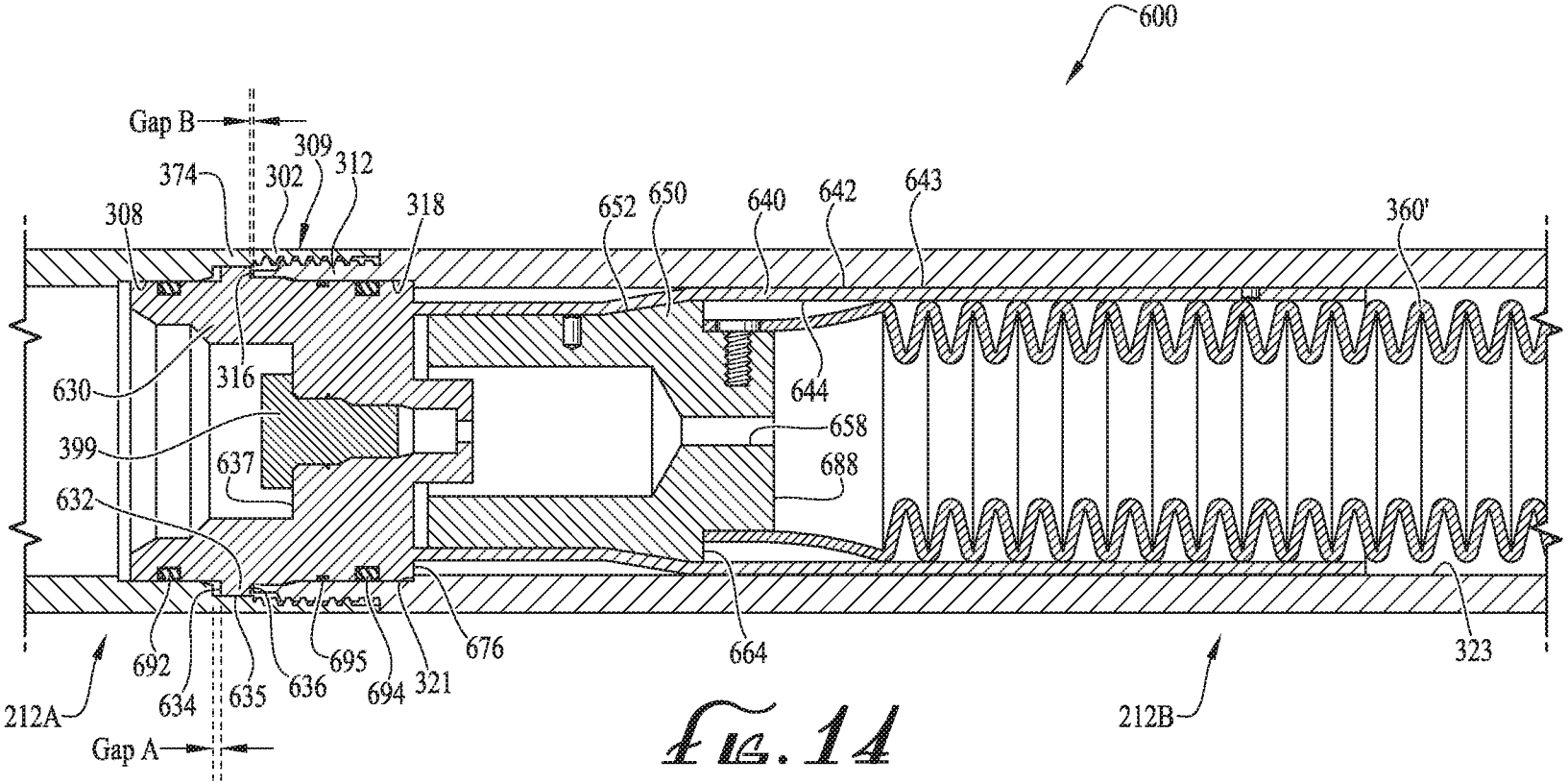
FIG. 14 is a cross-sectional view of an embodiment of a perforating gun apparatus after the upper gun section fires.

Turning now to FIG. 14, the bulkhead connection 600 may be reconfigured as shown after the upper gun body 212A perforates the casing. The gun apparatus 34 may be moved to a second zone 40 by work string 32 and the service personnel at surface may command the gun apparatus 34 to fire the upper gun section 210A. The upper gun body 212A may be uphole of the threaded bulkhead connection 300 and threadingly attached to the upper end portion. The charges 204A and detonator cord 208 may be fired simultaneously to perforate the casing 16 in a zone 40 in the well. The near simultaneous detonation of the charges 204A and detonator cord 208 may create an internal shockwave and pressure spike event that moves the bulkhead connector 330 downhole or towards the bottom end of the gun apparatus 34.

The bulkhead connector 630 may remain sealingly engaged to the upper sealing surface 308 of the upper gun body thread 302 with upper seal 692. The threaded connection 309 of upper gun body thread 302 and lower gun body thread 312 may be isolated from the pressure spike event by upper seal 692. The bulkhead connector 630 may move downhole or towards the bottom of the tool assembly from the internal shockwave impacting the equipment receptacle 637 and plug 399 until the end surface 676 contacts the support shoulder 321 of the lower gun body 212B. The deformation of support sleeve 640 shown in FIG. 13 may result in the full cross-section of material, the thickness of material between the outer sleeve surface 642 and inner sleeve surface 644, bearing the stress of the internal shockwave impact on the equipment receptacle 337 and plug 399 along with the support shoulder 321 of the lower gun body 212B. The deformed support sleeve 340 may attenuate the impact of the internal shockwave and pressure spike by transferring the resultant forces through the contact stress between the outer sleeve surface 642 and the outer sleeve coating 643 to the inner surface 323 of the lower gun body 212B to the lower gun body 212B and preventing support shoulder 336 of the bulkhead connector 330 from contacting shoulder surface 316 of the lower gun body thread 312. The resulting movement may increase Gap A, the distance between upper shoulder surface 306 and upper support shoulder 634. The resulting movement may also decrease Gap B, the distance between shoulder surface 316 and support shoulder 636.

Bulkhead wedge 650 may remain connected to support sleeve 640 or the downward motion may cause the bulkhead wedge 650 to disengage from the support sleeve 640. The bulkhead wedge 650 may stay swaged underneath the outer sleeve surface 642 or may disengage to fall towards the bottom of the lower gun body 212B. Likewise, the downward motion may disconnect the deformed charge carrier 360' from the wedge 650.

Figure 15:
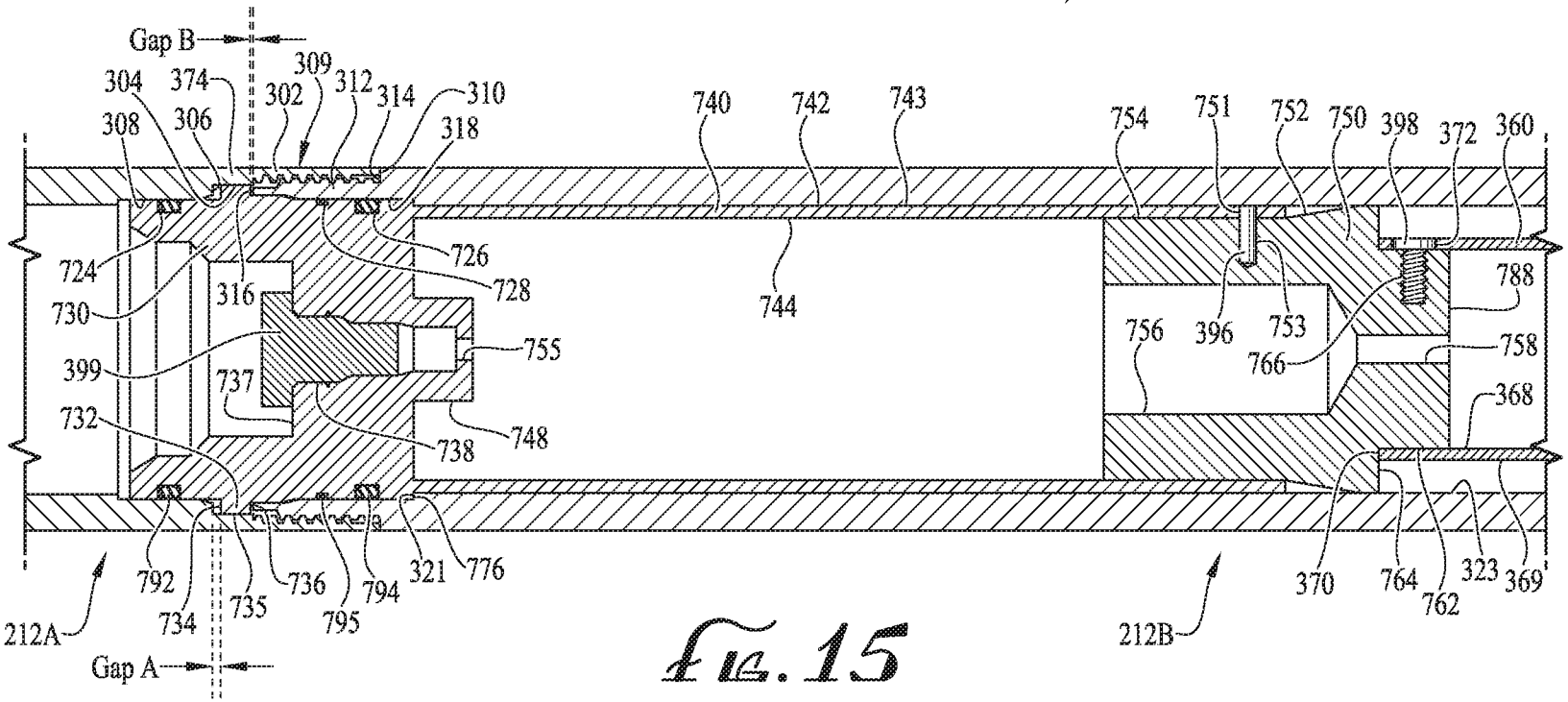
FIG. 15 is a cross-sectional view of an embodiment of a perforating gun apparatus comprising a shockwave attenuating connection.

FIG. 15 illustrates a cross-sectional view of an embodiment of the threaded bulkhead connection 700 configured to attenuate the internal shockwave created by the perforating gun sections. The upper gun body 212A may be threadingly attached to the upper end portion 200 and may be uphole of the threaded bulkhead connection 700. The threaded bulkhead connection 700 may comprise a bulkhead connector 730, bulkhead wedge 750, upper gun body thread 302, lower gun body thread 312, and charge carrier 360. The upper gun body 212A may be threadingly connected to lower gun body 212B with threaded connection 309. The threaded connection 309 of upper gun body thread 302 may be threadingly mated to lower gun body thread 312 until upper thread surface 310 engages lower thread surface 314. The upper gun body thread 302 forms a gun body housing 374 that includes upper shoulder surface 306, inner surface 304, and upper sealing surface 308. The lower gun body thread 312 may include lower shoulder surface 316, lower seal surface 318, and support shoulder 321.

Bulkhead connector 730 may be attached to and support bulkhead wedge 750 and charge carrier 360. Bulkhead connector 730 may be connected to bulkhead wedge 750 by connector pin 396. Charge carrier 360 may be connected to bulkhead wedge 750 by screw 398.

Bulkhead connector 730 may be cylindrical with an outer surface 735 and a support ring 732 having an upper support shoulder 734 and lower support shoulder 736. Bulkhead connector 730 may be installed inside gun body housing 374 with an allowance fit between outer surface 735 and inner surface 304 of gun body housing 374. The support ring 732 of the bulkhead connector 730 may be free to move axially inside gun body housing 374 between upper shoulder surface 306 and shoulder surface 316. The upper support shoulder 734 of the bulkhead connector 730 and upper shoulder surface 306 may be separated by Gap A. The lower support shoulder 736 of the bulkhead connector 730 and shoulder surface 316 of the may be separated by Gap B. The end surface 776 of the bulkhead connector 730 may abut the support shoulder 321 of the lower gun body thread 312. The bulkhead connector 730 may have upper seal groove 724 with upper seal 792 in sealing engagement with upper sealing surface 308 of the upper gun body 212A. The bulkhead connector 730 may have lower seal groove 726 with lower seal 794 in sealing engagement with lower seal surface 318 of lower gun body 212B. The bulkhead connector 730 may allow wellbore fluid to enter the threaded connection 309 of upper gun body thread 302 and lower gun body thread 312 while isolating the upper gun section 210A and lower gun section 210B from wellbore fluids with upper seal 792 in sealing engagement with upper sealing surface 308 and lower seal 794 in sealing engagement with lower seal surface 318. The bulkhead connector 730 may have grounding spring groove 728 with grounding spring 795 forming an electrically conductive path between lower seal surface 318 of lower gun body 212B and grounding spring groove 728 of bulkhead connector 730. The bulkhead connector 730 may have an equipment receptacle 737 with an inner thread 738 and seal surface for detonators, isolators, and other equipment. For example, the plug 399 may represent isolators, detonators, and other equipment that sealingly attach to the equipment receptacle 737 to isolate the upper gun body 212A from the lower gun body 212B and provide a communication path for the communication cable 209. In an alternate embodiment, the plug 399 may not seal, but pass a detonator cord 208 from the upper gun body 212A to the lower gun body 212B.

The bulkhead connector 730 may have support sleeve 740 with outer sleeve surface 742, inner sleeve surface 744, and outer sleeve coating 743. The support sleeve 740 may slidingly fit inside the lower gun body 212B with an allowance fit. The outer sleeve coating 743 may be a polymer coating, an elastomer coating, a rubberized coating, or may include sand or grit particles. The bulkhead connector 730 may have inner connector protrusion 748 for engagement with associated equipment and lower port 755 for passage of a communication cable 111 and/or detonator cord 208. The bulkhead connector 730 may have end surface 776 abutting support shoulder 321 to support bulkhead connector 730 between upper gun body 212A and lower gun body 212B. In an alternate embodiment, support sleeve 740 may be a separate part and threadingly attached, connected with fasteners, or slidingly connected to bulkhead connector 730.

The bulkhead wedge 750 may be held in place by connector pin 396 installed in support sleeve hole 751 and wedge hole 753. Connector pin 396 may be made from a material designed to shear when subjected to a specified load. The connector pin 396 may comprise brass, stainless steel, annealed steel, nickel steel, or any other shearable material known to those in the arts. The bulkhead wedge 750 may be a cylinder with an outer surface 754 in sliding engagement with inner sleeve surface 744 and a wedge surface 752 that may be frustoconical in shape. The bulkhead wedge 750 may have an inner surface 756 and a cable port 758. The lower end of the bulkhead wedge 750 may have a lower outer surface 762, an end shoulder surface 764, and a lower pin hole 766.

The charge carrier 360 may be a cylinder with an outer surface 369, an inner surface 368, and an upper end surface 370. The upper end of the charge carrier may have one or more support holes 372 to receive the screw head of screw 398. The pin hole 766 may be threaded to receive screw 398.

The charge carrier 360 may be connected to the bulkhead wedge 750 by screw 398.

The inner surface 368 of charge carrier 360 slidingly fits onto the outer surface 762 of bulkhead wedge 750. The upper end surface 370 may abut end shoulder surface 764. The screw 398 may fit into support hole 372. Although one screw 398 is shown, multiple screws 398 and support holes 372 may be located around the outer surface 369 of the charge carrier 360.

Figure 16:
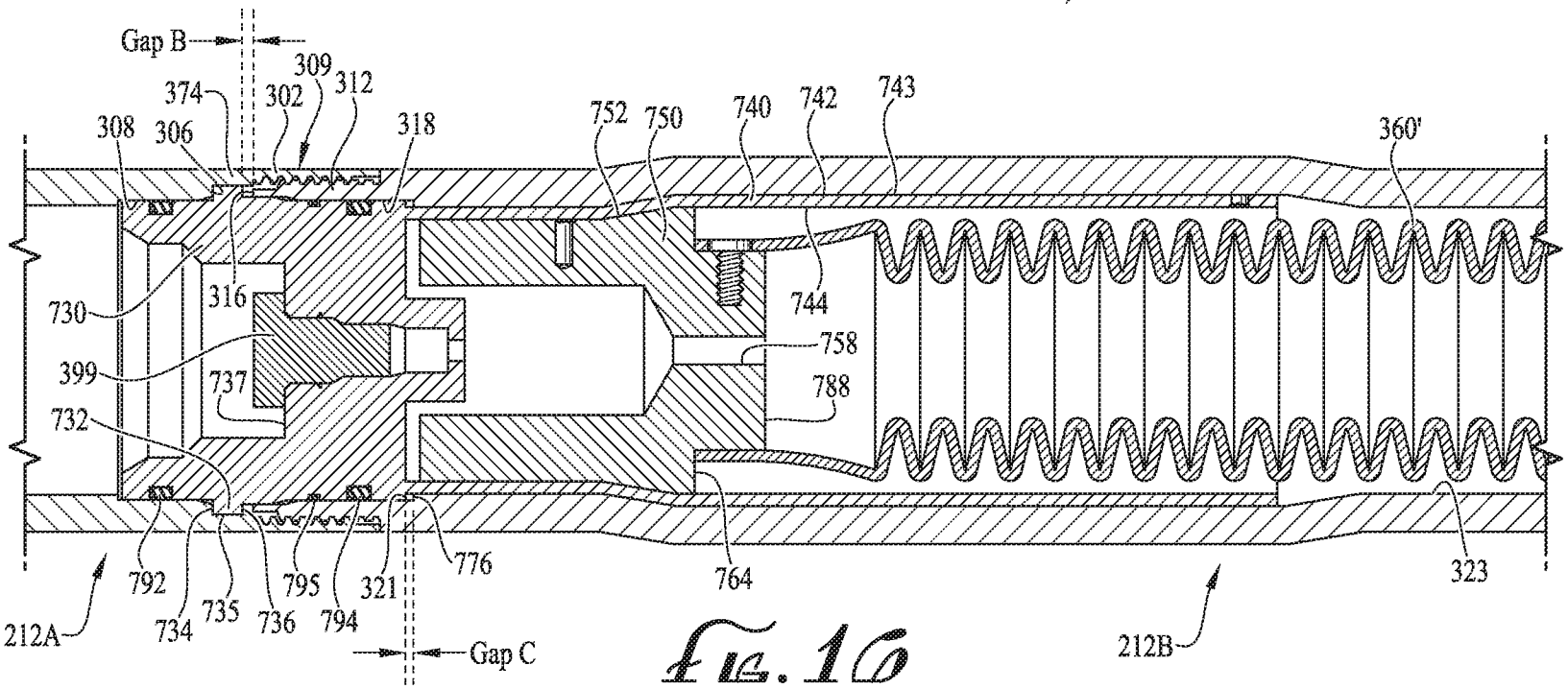
FIG. 16 is a cross-sectional view of an embodiment of a perforating gun apparatus after the lower gun section fires.

Turning now to FIG. 16, the charges 204B in the lower gun section 210B may be fired from a command given at surface by service personnel resulting in the threaded bulkhead connection 700 being reconfigured as shown. The near simultaneous firing of the charges and the detonator cord may cause an internal shockwave and a pressure spike from an inrush of wellbore fluids. The threaded bulkhead connection 700 may isolate the mated threaded connection 309 from damage from the shockwave, the instantaneous pressure event, or both.

The internal shockwave and pressure spike event created by charges 204B firing inside of lower gun body 212B may impact the bulkhead connection 700 to move the bulkhead connector 730 uphole (towards the top of gun apparatus 34), shear the connector pins 396, and move the bulkhead wedge 750 uphole. The bulkhead connector 730 may move uphole so that the upper support shoulder 734 of the bulkhead connector 730 contacts upper shoulder surface 306 of the upper gun body 212A. The contact area between the upper shoulder surface 306 and the upper support shoulder 734 receives the force of the shockwave and pressure spike. The contact stress of the upper shoulder surface 306 may be dependent on the amount of the shockwave and pressure spike attenuated away from the contact area as described below.

The shockwave may impact the bulkhead wedge 750 across the bottom surface 788 and end shoulder surface 764 and may shear the connector pins 396 and move the bulkhead wedge 750 uphole or towards the top of the gun apparatus 34. The bulkhead wedge 750 may move upward under support sleeve 740 so that the wedge surface 752 deforms the support sleeve 740 and the lower gun body 212B. The support sleeve 740 and the outer sleeve coating 743 on the outer sleeve surface 742 may be expanded into interference with the inner surface 323 of the lower gun body 212B causing the deformation of the inner surface 323 and outer surface of the lower gun body 212B. The upward movement of the bulkhead wedge 750 and the subsequent deformation of the support sleeve 740 and lower gun body 212B may attenuate the resultant force of the internal shockwave and pressure spike on the threaded bulkhead connection 700. The deformed support sleeve 740 with the expanded the outer sleeve surface 742 and inner sleeve surface 744 may remain deformed and in contact with the inner surface 323. The outer sleeve coating 743 may be compressed between the outer sleeve surface 742 and the inner surface 323 of the deformed lower gun body 212B and increase the frictional force of the resultant contact stress between the support sleeve 740 and the deformed lower gun body 212B. The bulkhead wedge 750 may be swaged underneath the deformed support sleeve 740 with an interference fit that transfers the shockwave into the lower gun body 212B, across the lower gun body thread 312, into the threaded connection 309, through the upper gun body thread 302, and into upper gun body 212A. The bulkhead wedge 750 swaged underneath the support sleeve 740 attenuates the shockwave and redirects the force of the shockwave away from the contact area of upper shoulder surface 306 and thereby reduces the contact stress applied to upper shoulder surface 306. The bulkhead wedge 750 may be swaged underneath the support sleeve 740 meaning an interference fit or force fit between inner sleeve surface 744 and wedge surface 752. The interference fit may keep the bulkhead wedge 750 attached to, or in contact with, the support sleeve 740. The movement of the bulkhead connector 730 may cause Gap A between upper support shoulder 734 and upper shoulder surface 306 to decrease to zero and Gap B measured between shoulder surface 316 and support shoulder 736 may increase. The Gap C measured between the end surface 776 and support shoulder 321 may increase in size.

The bulkhead connector 730 may isolate the upper gun body 212A from the pressure spike from lower gun body 212B and the inward rush of ambient wellbore fluids outside of the upper gun body 212A with the upper seal 792 in sealing engagement with upper seal surface 308, lower seal 794 in sealing engagement with lower seal surface 318, and plug 399 in sealing engagement with equipment receptacle 337.

The charge carrier 360 may deform from the near simultaneous firing of the charges 204B and the detonator cord 208. The charge carrier 360 may remain connected to the bulkhead wedge 750 or the force of the internal shockwave created by the simultaneous firing of the charges 204B may shear the screw 398 and separate the charge carrier 360 from the bulkhead wedge 750. Although the charge carrier 360 is illustrated as deformed charge carrier 360' with an accordion shape, the actual shape of the deformed charge carrier 360 may vary as the shockwave event may create a chaotic deformed shape.

In an alternate embodiment, the plug 399 may not seal, but pass a detonation cord 208 between the upper gun body 212A and lower gun body 212B. In this embodiment, the lower gun section 210B and upper gun section 210A may be fired nearly simultaneously. The threaded bulkhead connection 700 may be reconfigured as described above. The shockwave from the lower gun section 210B may be attenuated with the movement of the wedge 750 as described above. The inrush of wellbore fluids may pass through the plug 399 from the lower gun body 212B to the upper gun body 212A.

Figure 17:
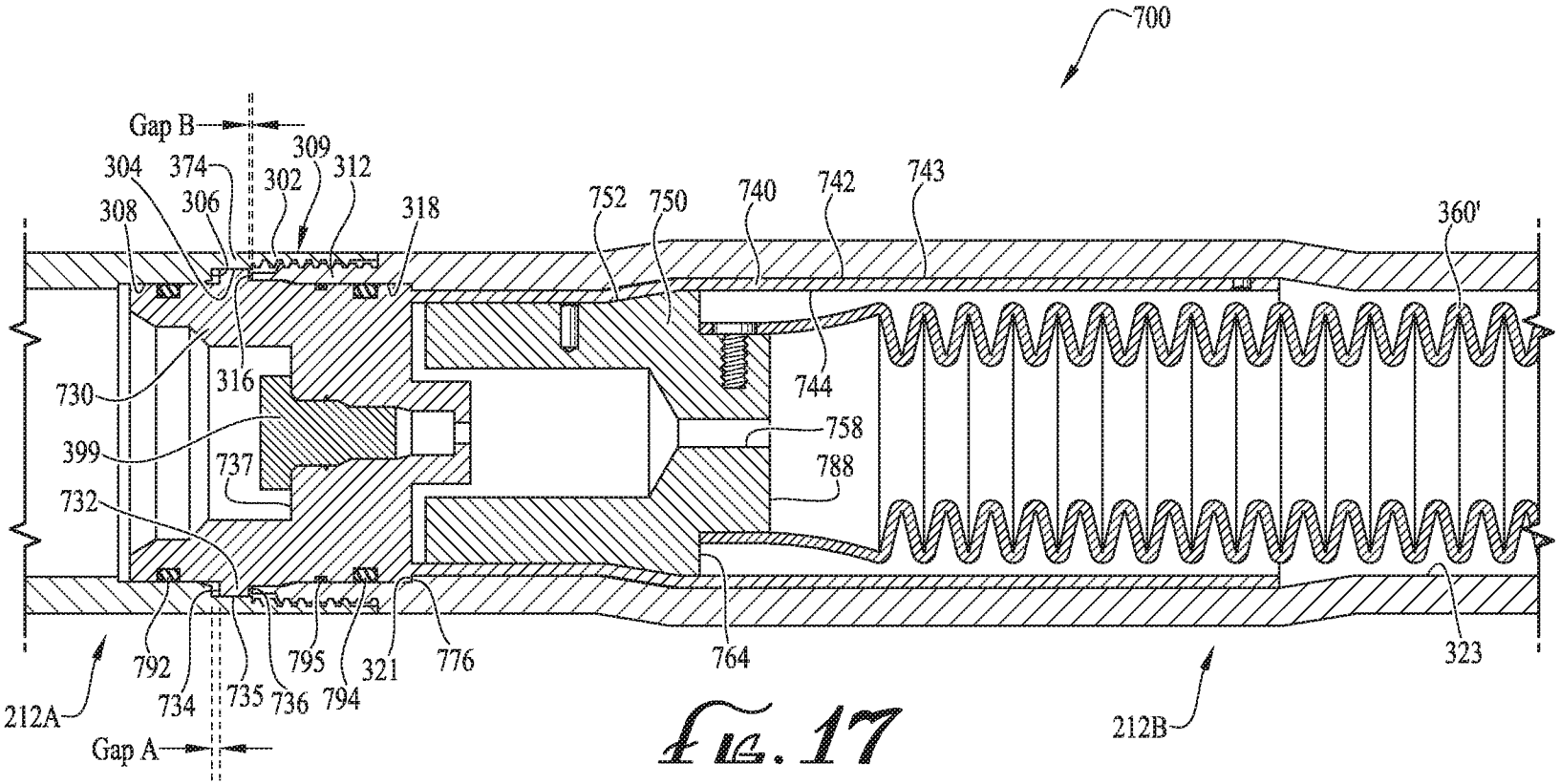
FIG. 17 is a cross-sectional view of an embodiment of a perforating gun apparatus after the upper gun section fires.

Turning now to FIG. 17, the bulkhead connection 700 may be reconfigured as shown after the upper gun body 212A perforates the casing. The gun apparatus 34 may be moved to a second zone 40 by work string 32 and the service personnel at surface may command the gun apparatus 34 to fire the upper gun section 210A. The upper gun body 212A may be uphole of the threaded bulkhead connection 700 and threadingly attached to the upper end portion. The charges 204A and detonator cord 208 may be fired simultaneously to perforate the casing 16 in a zone 40 in the well. The near simultaneous detonation of the charges 204A and detonator cord 208 may create an internal shockwave and pressure spike event that moves the bulkhead connector 730 downhole or towards the bottom end of the gun apparatus 34.

The bulkhead connector 730 may remain sealingly engaged to the upper sealing surface 308 of the upper gun body thread 302 with upper seal 792. The threaded connection 309 of upper gun body thread 302 and lower gun body thread 312 may be isolated from the pressure spike event by upper seal 792. The bulkhead connector 730 may move downhole or towards the bottom of the tool assembly from the internal shockwave impacting the equipment receptacle 737 and plug 399 until the end surface 776 contacts the support shoulder 321 of the lower gun body 212B. The deformation of support sleeve 740 shown in FIG. 16 may result in the full cross-section of material, the thickness of material between the outer sleeve surface 742 and inner sleeve surface 744, bearing the stress of the internal shockwave impact on the equipment receptacle 337 and plug 399 along with the support shoulder 321 of the lower gun body 212B. The deformed support sleeve 740 may attenuate the impact of the internal shockwave and pressure spike by transferring the resultant forces through the contact stress between the outer sleeve surface 742 and the outer sleeve coating 743 to the inner surface 323 of the lower gun body 212B to the lower gun body 212B and preventing support shoulder 736 of the bulkhead connector 730 from contacting shoulder surface 316 of the lower gun body thread 312. The resulting movement may increase Gap A, the distance between upper shoulder surface 306 and upper support shoulder 734. The resulting movement may also decrease Gap B, the distance between shoulder surface 316 and support shoulder 736.

Bulkhead wedge 750 may remain connected to the support sleeve 740 or the downward motion may cause the bulkhead wedge 750 to disengage from the bulkhead connector 730. The bulkhead wedge 750 may stay swaged underneath the outer sleeve surface 742 or may disengage to fall towards the bottom of the lower gun body 212B. Likewise, the downward motion may disconnect the deformed charge carrier 360' from the wedge 750.

A method of attenuating the force of an internal shockwave and pressure spike for a perforating gun apparatus may be described in the following manner. In an embodiment, the threaded bulkhead connection 300 may be connected within a gun body housing 374 between the upper gun body 212A on the upper gun section 210A and the lower gun body 212B on the lower gun section 210B. The bulkhead connector 330 may have support ring 332 slidingly engaged within a gun body housing 374 between upper gun body thread 302 and lower gun body thread 312. The bulkhead connector 330 may have upper seal 392 sealingly engaged with the seal upper sealing surface 308 of the upper gun body thread 302 and lower seal 394 sealingly engaged with lower seal surface 318 of lower gun body thread 312. The bulkhead connector 330 may have a support sleeve 340.

In an embodiment, the lower gun body 212B, (as shown in FIG. 3, FIG. 6, and FIG. 9) may include a lower gun body thread 312 with a lower shoulder surface 316, lower seal surface 318, inner groove 320, and lower seating shoulder 322. The support sleeve 340 may abut the lower seating shoulder 322. In an embodiment, (as shown in FIG. 3, FIG. 12, and FIG. 15) a bulkhead wedge 350 may be releasably attached to the support sleeve 340.

In an embodiment, the threaded bulkhead connection 400 may have a shock absorber plug 480 (as shown in FIG. 6) attached to or abutting bulkhead connector 430. In an embodiment, the bulkhead connector 430 (as shown in FIG. 6) may have a support sleeve 440 with an annular absorber 450 abutting annular end surface 564 and a shock absorber plug 480 abutting end surface 488 of the bulkhead connector 430.

In an embodiment, the threaded bulkhead connection 500 (as shown in FIG. 9) may have shock grooves 580 formed along the outer connector protrusion 548 forming radial walls 587 in bulkhead connector 530. In an embodiment, the threaded bulkhead connection 500 (as shown in FIG. 9) may have a slim wedge 550 abutting the support sleeve 540.

In an embodiment, the threaded bulkhead connection 600 (as shown in FIG. 12 and FIG. 15) may have a support sleeve 640 with an outer sleeve coating 643 applied to the outer sleeve surface 642. The bulkhead wedge 650 may be releasably attached to the support sleeve 640.

In an embodiment, the threaded bulkhead connection 300 may shift in a first direction responsive to a force generated by the firing of the first gun section. The support sleeve may deform responsive to the force generated by the firing of a first gun section. The deformation of the support sleeve 340 may attenuate the force generated by the firing of the first gun section 210 and lower the resultant stress of the threaded connection 309.

In an embodiment, the support sleeve 440 (as shown in FIG. 6) may be deformed by the force generated by the firing of the first gun section 210.

In an embodiment, the support sleeve 340 (as shown in FIG. 3, FIG. 12, and FIG. 15) may be deformed with the movement of the bulkhead wedge 350 responsive to the force generated by the firing of the first gun section 210. In an alternate embodiment, the support sleeve 540 may be deformed with the movement of a slim wedge 550 (as shown in FIG. 9) responsive to the force generated by the firing of the first gun section 210. In an alternate embodiment, the lower gun body 212B may be deformed with the movement of the bulkhead wedge 350 responsive to the force generated by the firing of the first gun section 210.

In an embodiment, the support sleeve 340 (as shown in FIG. 3, FIG. 6, and FIG. 9) may be deformed into an inner groove 320.

In an embodiment, the threaded bulkhead connection 400 (as shown in FIG. 6) may attenuate the force generated by the firing of a first gun section 210B with the deformation of the annular absorber 450 and shock absorber plug 480 and the subsequent deformation of the support sleeve 440 by the impact of the internal shockwave and/or pressure spike into inner groove 320.

In an embodiment, the threaded bulkhead connection 500 (as shown in FIG. 9) may attenuate the force generated by the firing of a first gun section 210B with the deformation of the shock grooves 580 and the radial walls 587, the upward movement of the slim wedge 550, and the subsequent deformation of the support sleeve 540 by the frustoconical upper surface 552 of the slim wedge 550 into inner groove 320.

In an embodiment, the threaded bulkhead connection 300 may isolate the threaded connection of the upper gun body thread 302 and the lower gun body thread 312 from the internal shockwave and pressure spike inside the lower gun body 212B with the upper seal 392 on the bulkhead connector 330 in sealing engagement with upper sealing surface 308 and with lower seal 394 in sealing engagement with lower seal surface 318.

In an embodiment, the threaded bulkhead connection 300 (as shown in FIG. 3, FIG. 6, and FIG. 9) may isolate the threaded connection 309 of the upper gun body thread 302 and the lower gun body thread 312 by transferring the force generated by the firing of a second gun section 210 into the deformed support sleeve 340 in inner groove 320 of the first gun body 212. The deformed support sleeve 340 may attenuate the impact of the internal shockwave and/or pressure spike by transferring the force to the first gun body 212 and thereby preventing support shoulder 336 of the bulkhead connector 330 from contacting shoulder surface 316 of the lower gun body thread 312.

In an embodiment, the threaded bulkhead connection 300 (as shown in FIG. 12 and FIG. 15) may isolate the threaded connection 309 of the upper gun body thread 302 and the lower gun body thread 312 by transferring the force generated by the firing of a second gun section 210 into the deformed support sleeve 340 of the first gun body 212. The deformed support sleeve 340 may attenuate the impact of the internal shockwave and/or pressure spike by transferring the force to the first gun body 212 through the interference fit between the deformed support sleeve 640 and inner surface 323 of the gun body 212 and thereby preventing support shoulder 336 of the bulkhead connector 330 from contacting shoulder surface 316 of the lower gun body thread 312. In an embodiment, the deformed support sleeve 740 may attenuate the impact of the internal shockwave and/or pressure spike by transferring the force to the first gun body 212 through the interference fit between the deformed support sleeve 640 and inner surface 323 of the deformed gun body 212 and thereby preventing support shoulder 336 of the bulkhead connector 330 from contacting shoulder surface 316 of the lower gun body thread 312.

In an embodiment, the threaded bulkhead connection 300 may isolate the threaded connection 309 of the upper gun body thread 302 and the lower gun body thread 312 from the shockwave and pressure spike inside the upper gun body 212A with the upper seal 392 on the bulkhead connector 330 in sealing engagement with upper sealing surface 308.

Figure 18:
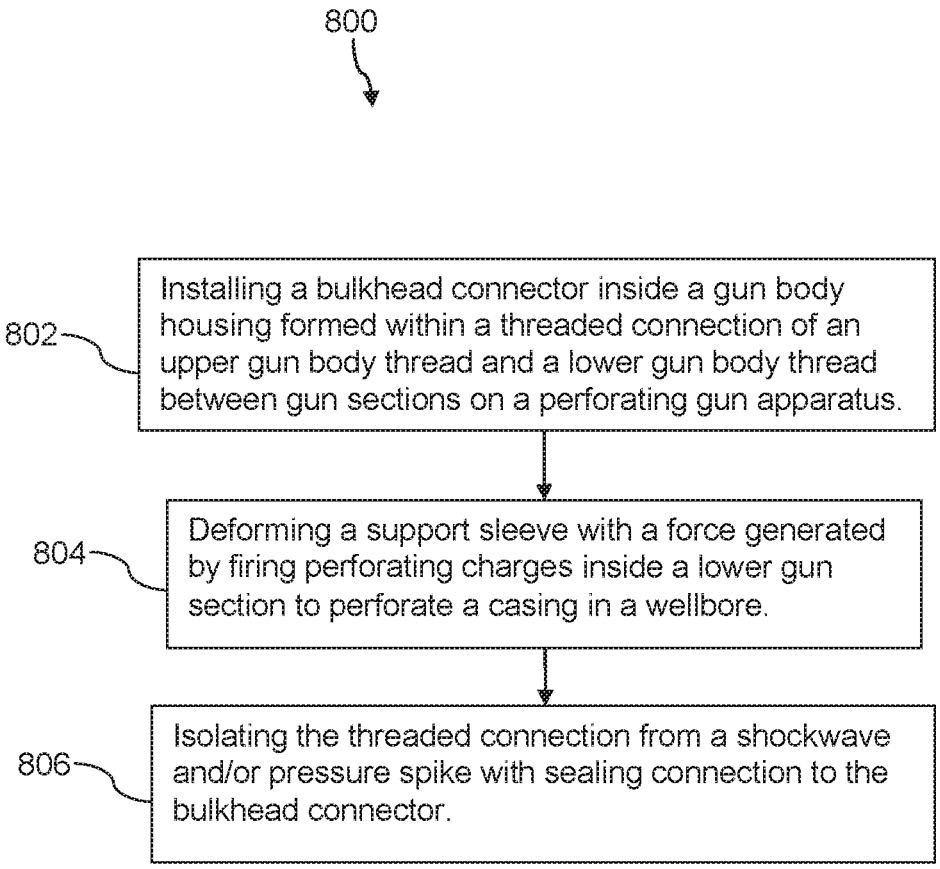
FIG. 18 is a flow chart of a method according to an embodiment of the disclosure.

Turning now to FIG. 18, a method 800 is described. In an embodiment, the method 800 comprises a method of servicing a well with a perforating gun with threaded connections protected from internal shock. At block 802, the method 800 comprises installing a bulkhead connector 330 inside a gun body housing 374 formed within a threaded connection 309 of an upper gun body thread 302 and a lower gun body thread 312 between gun sections 210 on a perforating gun apparatus 34.

At block 804, the method 800 comprises deforming a support sleeve 340 with a force generated by firing perforating charges 204 inside a lower gun section 210B to perforate a casing 16 in a wellbore 12.

At block 806, the method 800 comprises isolating the threaded connection 309 from a shockwave and/or pressure spike with sealing connection to the bulkhead connector 330.

Figure 19:
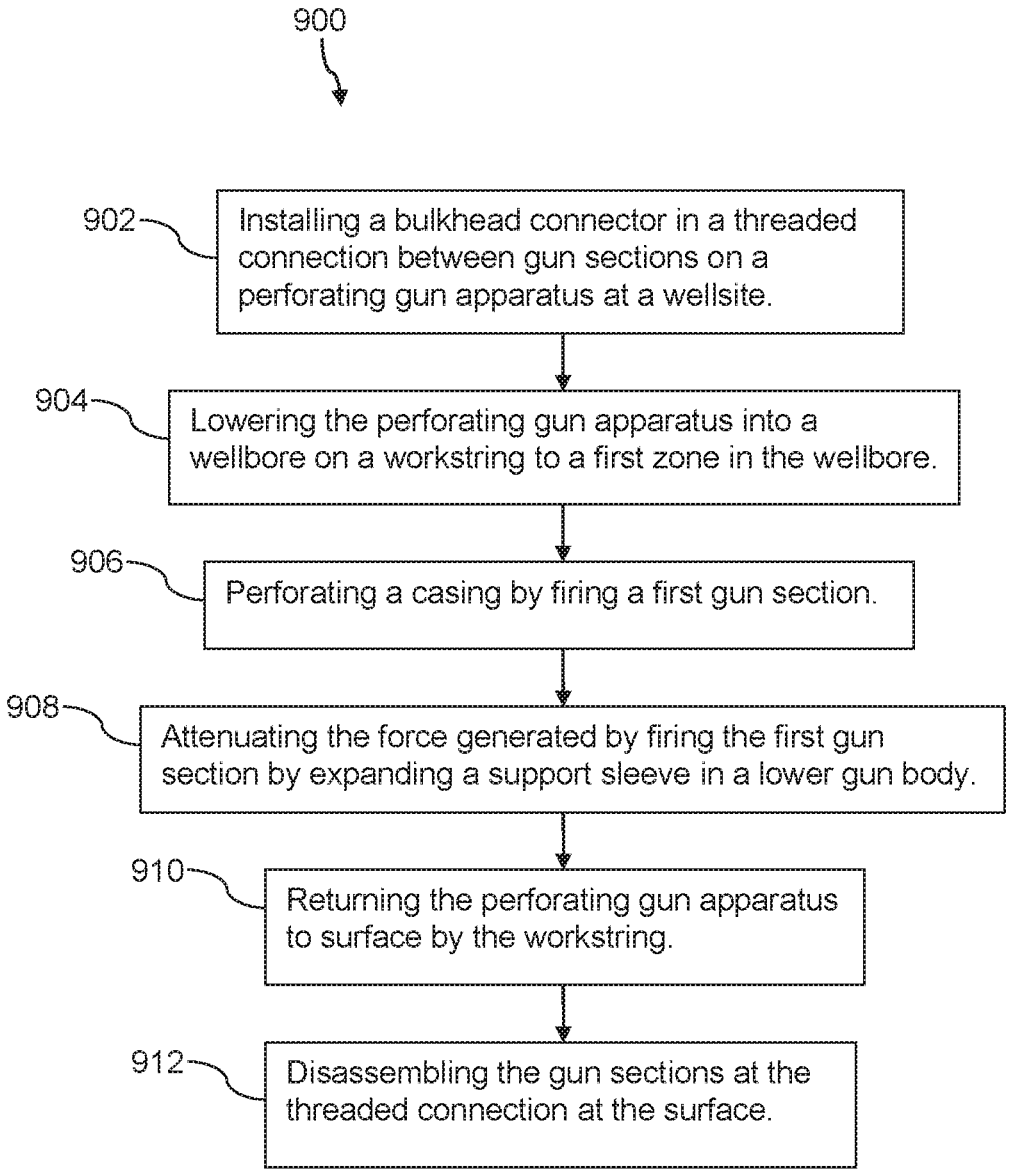
FIG. 19 is a flow chart of a method according to an embodiment of the disclosure.

Turning now to FIG. 19, a method 900 is described. In an embodiment, the method 900 comprises a method of servicing a well with a perforating gun with threaded connections protected from internal shock. At block 902, the method 900 comprises installing a bulkhead connector 330 in a threaded connection 309 between gun sections on a perforating gun apparatus 34 at a wellsite.

At block 904, the method 900 comprises lowering the perforating gun apparatus into a wellbore 12 on a workstring 30 to a first zone in the wellbore 12. At block 906, the method 900 comprises perforating a casing 16 by firing a first gun section 210. At block 908, the method 900 comprises attenuating the force generated by firing the first gun section 210 by expanding a support sleeve 340 in a lower gun body 212B.

At block 910, the method 900 comprises returning the gun apparatus 34 to surface by the workstring 30. At block 912, the method 900 comprises disassembling the gun sections at the threaded connection 309 at the surface.

Although the orientation of the drawings may indicate vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

ADDITIONAL DISCLOSURE

The following are nonlimiting, specific embodiments in accordance with the present disclosure:

A first embodiment, which is a perforating gun apparatus comprising an upper gun body 212A connected via a threaded connection 309 to a lower gun body 212B to form a gun body housing 374, the upper gun body 212A generally defining a cylinder with an upper gun body thread 302 and an upper sealing surface 308, the lower gun body 212B generally defining a cylinder with a lower gun body thread 312 and a lower sealing surface 318, and wherein the threaded connection 309 includes the upper gun body thread 302 threadingly engaged with the lower gun body thread 312, a bulkhead connector 330 generally defining a cylinder with an outer cylindrical surface 335 forming a support ring 332; wherein the support ring 332 is movably positioned within the gun body housing 374; and a support sleeve 340 generally defining a cylinder connected to the bulkhead connector 330, wherein the support sleeve is radially deformable from a force generated by firing a first gun section.

A second embodiment, which is the perforating gun apparatus of the first embodiment, further comprising a lower gun body 212B with an inner groove 320, and lower seating shoulder 322, wherein a support sleeve end surface 346 abuts the lower seating shoulder 322.

A third embodiment, which is the perforating gun apparatus of the first embodiment, further comprising a bulkhead wedge 350 generally defining a cylinder with a frustoconical surface positioned adjacent to the support sleeve 340.

A fourth embodiment, which is the perforating gun apparatus of the third embodiment, wherein the bulkhead wedge 350 is releasably connected to the support sleeve 340.

A fifth embodiment, which is the perforating gun apparatus of any of the first embodiment or the third embodiment, wherein the support sleeve 340 is deformable by the bulkhead wedge 350 impacted by a force generated by a firing of a perforating gun section 210.

A sixth embodiment, which is the perforating gun apparatus of any of the first embodiment or the fifth embodiment, wherein the support sleeve 340 is deformable by an internal shockwave and/or pressure spike.

A seventh embodiment, which is the perforating gun apparatus of any of the first embodiment, the fifth embodiment, or the sixth embodiment, wherein the deformation of the support sleeve 340 attenuates the internal shockwave and/or pressure spike.

An eighth embodiment, which is the perforating gun apparatus of any of the first embodiment, the fifth embodiment, the sixth embodiment, or the seventh embodiment, wherein the support sleeve 340 is deformable by an internal shockwave and/or pressure spike into the inner groove 320.

A ninth embodiment, which is the perforating gun apparatus of any of the first embodiment, the fifth embodiment, the sixth embodiment, the seventh embodiment, or the eight embodiment, further comprising a shock absorbing plug adjacent to the bulkhead connector 430 with a cylinder shape and one or more radial walls 487 deformable by an impact from an internal shockwave and/or pressure spike; and wherein the deformation attenuates the internal shockwave and/or pressure spike.

A tenth embodiment, which is the perforating gun apparatus of any of the first embodiment or the ninth embodiment, further comprising one or more radial walls 587 on the bulkhead connector 530 deformable by an impact from an internal shockwave and/or pressure spike; and wherein the deformation attenuates the internal shockwave and/or pressure spike.

An eleventh embodiment, which is the perforating gun apparatus of any of the first embodiment, the ninth embodiment, or the tenth embodiment, further comprising an annular absorber 450 abutting the bulkhead connector 430 in a cylindrical shape with a corrugated structure deformable by an impact from an internal shockwave or pressure spike; and wherein the deformation attenuates the internal shockwave and/or pressure spike.

A twelfth embodiment, which is the perforating gun apparatus of the first embodiment, further comprising an inner threaded receptacle 338 and equipment receptacle 537 in the bulkhead connector 530 to isolate upper gun section 210A from a pressure spike in the lower gun section 210B.

A thirteenth embodiment, which is the perforating gun apparatus of the first embodiment, further comprising at least one explosive device disposed in the gun body 212 that when activated pierces the gun body 212, casing 16, and generates an internal shockwave and/or pressure spike.

A fourteenth embodiment, which is the perforating gun apparatus of the first embodiment, wherein the upper seal 392 and lower seal 394 in the bulkhead connector 330 isolates the threaded engagement of the upper gun body thread 302 and lower gun body thread 312 from an internal shockwave and/or pressure spike.

A fifteenth embodiment, which is the perforating gun apparatus of the first embodiment, wherein the deformed support sleeve 340 within an inner groove 320 attenuates a resultant force from the shockwave and/or pressure spike into the upper gun body 212A.

A sixteenth embodiment, which is a method, comprising installing a bulkhead connector 330 inside a gun body housing 374 formed within a threaded connection 309 of an upper gun body thread 302 and a lower gun body thread 312 between gun sections 210 on a perforating gun apparatus 34, deforming a support sleeve 340 with a force generated by firing perforating charges 204 inside a lower gun section 210B to perforate a casing 16 in a wellbore 12, and isolating the threaded connection 309 from a shockwave and/or pressure spike with sealing connection to the bulkhead connector 330.

A seventeenth embodiment, which is the method of the sixteenth embodiment, wherein deforming the support sleeve 340 attenuates the force generated by firing the perforating gun sections.

An eighteenth embodiment, which is the method of the sixteenth embodiment, wherein transferring the force of a shockwave and/or pressure spike produced by firing the perforating charges inside an upper gun section 210A to the deformed support sleeve 340; and isolating the threaded connection 309 from the shockwave and/or pressure spike with sealing connection to the bulkhead connector 330.

A nineteenth embodiment, which is the method of the sixteenth embodiment, wherein attenuating the force of an internal shockwave and/or pressure spike inside an upper gun section 210 with a deformed support sleeve 340.

An twentieth embodiment, which is a method, comprising installing a bulkhead connector 330 in a threaded connection 309 between gun sections on a perforating gun apparatus 34 at a wellsite, lowering the perforating gun apparatus into a wellbore 12 on a workstring 30 to a first zone in the wellbore 12, perforating a casing 16 by firing a first gun section 210, attenuating the force generated by firing the first gun section 210 by expanding a support sleeve 340 in a lower gun body 212B, returning the perforating gun apparatus 34 to surface by the workstring 30, and disassembling the gun sections at the threaded connection 309 at the surface.

A twenty-first embodiment, which is the method of the twentieth embodiment, further comprising repositioning the perforating gun apparatus 34 to a second zone within the wellbore 12 with the workstring 30, perforating the casing 16 by firing a second gun section 210, transferring an internal shockwave impacting the bulkhead connector 330 to the expanded support sleeve 340, and isolating the threaded connection 309 from an internal pressure spike.

A twenty-second embodiment, which is the method of the twentieth embodiment, wherein a shock absorber attenuates the force of the shockwave and/or pressure spike.

A twenty-third embodiment, which is the method of the twentieth embodiment, wherein a bulkhead wedge 350 expands the support sleeve 340 into an inner groove 320 in the lower gun body 212B.

A twenty-fourth embodiment, which is the method of the twentieth embodiment, wherein a shockwave and/or pressure spike deforms the support sleeve 340 into an inner groove 320 in the lower gun body 212B.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, . . . 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A perforating gun apparatus comprising:

an upper gun body connected via a threaded connection to a lower gun body to form a gun body housing;

the upper gun body generally defining a cylinder with an upper gun body thread and an upper sealing surface;

the lower gun body generally defining a cylinder with a lower gun body thread and a lower sealing surface;

wherein the threaded connection includes the upper gun body thread threadingly engaged with the lower gun body thread;

a bulkhead connector generally defining a cylinder with an outer cylindrical surface forming a support ring; wherein the support ring is movably positioned within the gun body housing; and a support sleeve generally defining a cylinder connected to the bulkhead connector, wherein the support sleeve is radially deformable from a force generated by firing a first gun section.

2. The perforating gun apparatus of claim 1, further comprising a bulkhead wedge generally defining a cylinder with a frustoconical surface positioned adjacent to the support sleeve.

3. The perforating gun apparatus of claim 2, wherein the support sleeve is deformable by the bulkhead wedge impacted by a force generated by a firing of a perforating gun section.

4. The perforating gun apparatus of claim 1, wherein the support sleeve is deformable by an internal shockwave or pressure spike.

5. The perforating gun apparatus of claim 1, wherein the deformation of the support sleeve attenuates the internal shockwave or pressure spike.

6. The perforating gun apparatus of claim 1, further comprising a shock absorbing plug adjacent to the bulkhead connector with a cylinder shape and one or more radial walls deformable by an impact from an internal shockwave or pressure spike; and wherein the deformation attenuates the internal shockwave or pressure spike.

7. The perforating gun apparatus of claim 1, further comprising one or more radial walls on the bulkhead connector deformable by an impact from an internal shockwave or pressure spike; and wherein the deformation attenuates the internal shockwave or pressure spike.

8. The perforating gun apparatus of claim 1, further comprising an annular absorber abutting the bulkhead connector in a cylindrical shape with a corrugated structure deformable by an impact from an internal shockwave or pressure spike; and wherein the deformation attenuates the internal shockwave or pressure spike.

9. The perforating gun apparatus of claim 1, further comprising an inner threaded receptacle and inner seal surface in the bulkhead connector to isolate upper gun section from a pressure spike in the lower gun section.

10. The perforating gun apparatus of claim 1, further comprising at least one explosive device disposed in the gun body that when activated pierces the gun body, casing, and generates an internal shockwave or pressure spike.

11. The perforating gun apparatus of claim 1, wherein the upper seal and lower seal in the bulkhead connector isolates the threaded engagement of the upper gun body thread and lower gun body thread from an internal shockwave or pressure spike.

12. The perforating gun apparatus of claim 1, wherein the deformed support sleeve within an inner groove attenuates a resultant force from the shockwave or pressure spike into the upper gun body.

13. A method, comprising:

installing a bulkhead connector inside a gun body housing formed within a threaded connection of an upper gun body thread and a lower gun body thread between upper and lower gun sections on a perforating gun apparatus, wherein the bulkhead connection comprises a support sleeve generally defining a cylinder connected to the bulkhead connector and wherein the support sleeve is radially deformable from a force generated by firing the lower gun section;

deforming a support sleeve with a force generated by firing perforating charges inside the lower gun section to perforate a casing in a wellbore; and isolating the threaded connection from a shockwave or pressure spike with sealing connection to the bulkhead connector.

14. The method of claim 13, wherein deforming the support sleeve attenuates the force generated by firing the perforating gun sections.

15. The method of claim 13, further comprising transferring the force of a shockwave or pressure spike produced by firing the perforating charges inside an upper gun section to the deformed support sleeve; and isolating the threaded connection from the shockwave or pressure spike with sealing connection to the bulkhead connector.

16. The method of claim 13, further comprising attenuating the force of an internal shockwave or pressure spike inside an upper gun section with a deformed support sleeve.

17. A method of servicing a wellbore, comprising:

installing a bulkhead connector in a threaded connection between gun sections on a perforating gun apparatus at a wellsite, wherein the bulkhead connection comprises a support sleeve generally defining a cylinder connected to the bulkhead connector and wherein the support sleeve is radially deformable from a force generated by firing one of the gun section;

lowering the perforating gun apparatus into a wellbore on a workstring to a first zone in the wellbore;

perforating a casing by firing a first gun section;

attenuating the force generated by firing the first gun section by expanding the support sleeve in a lower gun body;

returning the perforating gun apparatus to surface by the workstring; and disassembling the gun sections at the threaded connection at the surface.

18. The method of claim 17, further comprising repositioning the perforating gun apparatus to a second zone within the wellbore with the workstring; perforating the casing by firing a second gun section; transferring an internal shockwave impacting the bulkhead connector to the expanded support sleeve; and isolating the threaded connection from an internal pressure spike.

19. The method of claim 17, wherein a shock absorber attenuates the force of the shockwave or pressure spike.

20. The method of claim 17, wherein a bulkhead wedge expands the support sleeve into an inner groove in the lower gun body.

* * * * *